US009156077B2

(12) United States Patent
Brottlund et al.

(10) Patent No.: US 9,156,077 B2
(45) Date of Patent: Oct. 13, 2015

(54) METHOD OF MAKING BORDER WIRE

(71) Applicant: L&P Property Management Company, South Gate, CA (US)

(72) Inventors: Von W. Brottlund, Pierce City, MO (US); Travis L. Brummett, Carthage, MO (US); Kelly M. Knewtson, Joplin, MO (US); Thomas J. Mitchell, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 322 days.

(21) Appl. No.: 13/851,331

(22) Filed: Mar. 27, 2013

(65) Prior Publication Data

US 2013/0255823 A1 Oct. 3, 2013

Related U.S. Application Data

(60) Provisional application No. 61/617,275, filed on Mar. 29, 2012.

(51) Int. Cl.

| | |
|---|---|
| ***B21F 5/00*** | (2006.01) |
| ***B21B 13/00*** | (2006.01) |
| ***B21F 1/02*** | (2006.01) |
| ***B21F 1/00*** | (2006.01) |
| ***B21F 11/00*** | (2006.01) |
| ***A47C 23/00*** | (2006.01) |
| ***B21F 15/08*** | (2006.01) |
| ***A47C 27/06*** | (2006.01) |

(Continued)

(52) U.S. Cl.

CPC ..... *B21F 5/005* (2013.01); *A47C 23/002* (2013.01); *A47C 23/007* (2013.01); *A47C 27/066* (2013.01); *B21B 1/166* (2013.01); *B21B 13/00* (2013.01); *B21C 49/00* (2013.01); *B21C 51/00* (2013.01); *B21F 1/00* (2013.01); *B21F 1/002* (2013.01); *B21F 1/02* (2013.01); *B21F 11/00* (2013.01); *B21F 15/08* (2013.01); *B21F 27/12* (2013.01); *B68G 15/00* (2013.01)

(58) Field of Classification Search

CPC ..... B21F 1/02; B21F 1/026; B21F 11/00; B21F 15/02; B21F 15/08; B21F 23/005; B21F 27/12; B21F 27/16; B21B 1/166; A47C 27/066; A47C 23/007

USPC ..... 140/1, 92.1; 72/306, 307

See application file for complete search history.

(56) References Cited

U.S. PATENT DOCUMENTS 2,517,309 A 8/1950 Heller
3,417,593 A * 12/1968 Lewis ..... 72/211

(Continued)

FOREIGN PATENT DOCUMENTS

JP 2004122237 4/2004

*Primary Examiner* — Edward Tolan

(74) *Attorney, Agent, or Firm* — Wood, Herron & Evans, LLP

(57) ABSTRACT

An apparatus is provided which makes a border wire having a rectangular cross-section. The apparatus is adapted to receive a roll of wire having a circular cross-section, straighten the wire and change the cross-section of the wire to rectangular. The reconfigured wire is then accumulated, passed through another straightener, cut to size and then bent into a rectangular configuration. Opposed ends of the piece of wire having a rectangular cross-section are welded together to complete the border wire. The apparatus has an ejector which removes the completed border wire from the apparatus.

19 Claims, 23 Drawing Sheets

(51) Int. Cl.

| | |
|---|---|
| ***B68G 15/00*** | (2006.01) |
| ***B21C 49/00*** | (2006.01) |
| ***B21C 51/00*** | (2006.01) |
| ***B21F 27/12*** | (2006.01) |
| ***B21B 1/16*** | (2006.01) |

(56) References Cited

U.S. PATENT DOCUMENTS

| | | | | |
|---|---|---|---|---|
| 3,587,673 | A * | 6/1971 | Smirnov et al. | 140/1 |
| 3,893,316 | A | 7/1975 | Simich | |
| 4,219,052 | A | 8/1980 | Aronhalt | |
| 4,280,350 | A | 7/1981 | King et al. | |
| 4,464,919 | A | 8/1984 | Labbe | |
| 4,612,792 | A | 9/1986 | De Bondt et al. | |
| 4,642,786 | A | 2/1987 | Hansen | |
| 4,823,576 | A | 4/1989 | Yoshioka | |
| 5,088,310 | A * | 2/1992 | Anagnostopoulu | 72/306 |
| 5,136,867 | A | 8/1992 | Zuger | |
| 5,170,654 | A * | 12/1992 | Anagnostopoulos | 72/299 |
| 5,495,427 | A | 2/1996 | Puma et al. | |
| 5,676,010 | A | 10/1997 | College et al. | |
| 5,826,472 | A | 10/1998 | Tamura et al. | |
| 6,584,823 | B2 | 7/2003 | Hresc et al. | |
| 7,188,504 | B2 * | 3/2007 | Latour | 72/307 |
| 7,721,582 | B2 * | 5/2010 | Speck | 72/306 |
| 7,878,038 | B2 * | 2/2011 | Anagnostopoulos | 72/299 |
| 8,327,475 | B2 | 12/2012 | Haffner et al. | |
| 8,332,974 | B2 | 12/2012 | Haffner et al. | |
| 2001/0032359 | A1 | 10/2001 | Anagnostopoulos | |
| 2004/0050131 | A1 | 3/2004 | Militaru et al. | |
| 2011/0314613 | A1 | 12/2011 | Haffner et al. | |

* cited by examiner

METHOD OF MAKING BORDER WIRE

CROSS REFERENCE TO RELATED APPLICATIONS

This application claims the benefit of the filing date of U.S. Provisional Patent Application Ser. No. 61/617,275 filed Mar. 29, 2012 entitled "Method of Making Border Wire and Apparatus For Practicing Method", which is fully incorporated by reference herein.

TECHNICAL FIELD

The present invention relates generally to bedding products and the method and apparatus for making a rectangular border wire or frame used in a bedding or seating product.

BACKGROUND

In the bedding industry, bedding foundations and spring cores used for mattresses have at least one border wire. The border wire may assume a rectangular shape, including a square.

The border wires of spring cores used for mattresses and sometimes furniture, including seating products, are usually made from wire having a circular cross-section. However, applicant's U.S. patent application Ser. No. 12/821,754, published on Dec. 29, 2011 as Publication No. 2011/0314613, and fully incorporated by reference herein, discloses a spring core having a border wire having a rectangular cross-section.

In addition, a bedding foundation or box spring may have a rectangular border wire having a circular cross-section. However, applicant's U.S. Pat. Nos. 8,327,475 and 8,332,974, each being fully incorporated by reference herein, disclose a bedding foundation having a border wire having a rectangular cross-section.

Straightening wire having a rectangular cross-section requires a different apparatus than straightening wire having a circular cross-section. The apparatus used to straighten wire having a circular cross-section requires adjustment to the machinery be made manually. The apparatus used to straighten wire having a rectangular cross-section may use servo motors to manipulate the wire electronically. Applicant's U.S. patent application Ser. No. 13/179,039, fully incorporated by reference herein, discloses an apparatus used to straighten wire having a rectangular cross-section. The use of servo motors enables wire having a rectangular cross-section to be straightened quickly and easily without manual mechanical adjustments. The set-up time is much less with the apparatus disclosed in applicant's U.S. patent application Ser. No. 13/179,039.

Thus, a need exists in the art for an automated method of making a border wire made of wire having a rectangular cross-section.

SUMMARY OF THE INVENTION

According to one aspect of the invention, a method of making a border wire for a bedding product comprises providing a source of wire having a circular cross-section, unwinding it from its roll and straightening it. The next step comprises passing the wire having a circular cross-section through a metal forming machine to create a wire having a rectangular cross-section. The next step comprises accumulating the wire having a rectangular cross-section in an accumulator. The wire having a rectangular cross-section is then passed through a three-axis straightener. A predetermined length of wire having a rectangular cross-section is measured. The next step comprises cutting the wire having a rectangular cross-section to a predetermined length to obtain a piece of wire having a rectangular cross-section. The piece of wire having a rectangular cross-section is then bent using four bending assemblies into a rectangular configuration. Opposed ends of the piece of wire having a rectangular cross-section are welded together to create a rectangular border wire.

According to another aspect of the invention, an apparatus for making a rectangular border wire having a rectangular cross-section comprises a wire holder adapted to hold a roll of wire having a circular cross-section. The apparatus further comprises a wire payoff and a two-plane straightener downstream of the wire payoff. The apparatus further comprises a metal forming machine downstream of the two-plane straightener which changes the cross sectional shape of the wire along with an accumulator downstream of the metal forming machine. A three-axis straightener is located downstream of the accumulator, and a feed assembly is provided downstream of the three-axis straightener. A bender section comprising multiple bender assemblies driven by servo motors is located downstream of the cutter; and a welder is located proximate the bender section. The apparatus may further comprise an ejector.

The present straightening method allows the wire straightening to be completed quickly and, in most cases, without the use of mechanical tools. The adjustments may be repeatable and more precise than heretofore. Stored data allows for quick changes and repeatable set-ups between wire gauges and heats. Border wires having rectangular cross-sections may be made more quickly than conventional border wires having round cross-sections using the present method and apparatus. The amount of scrap metal is reduced using the present invention. Contact and non-contact detection systems may automatically detect the position and orientation of the wire. These systems may include at least one of the following: laser systems; vision systems; object detection systems using insensitive probes; magnetic field detection systems; ultrasonic field detection systems; and, sonar measuring systems.

BRIEF DESCRIPTION OF THE DRAWINGS

The accompanying drawings, which are incorporated in and constitute a part of this specification, illustrate embodiments of the invention and, together with the general description given above and the detailed description of the embodiments given below, serve to explain the principles of the invention. In the figures, corresponding or like numbers or characters indicate corresponding or like structures.

DETAILED DESCRIPTION OF THE ILLUSTRATIVE EMBODIMENTS

Figure 1:
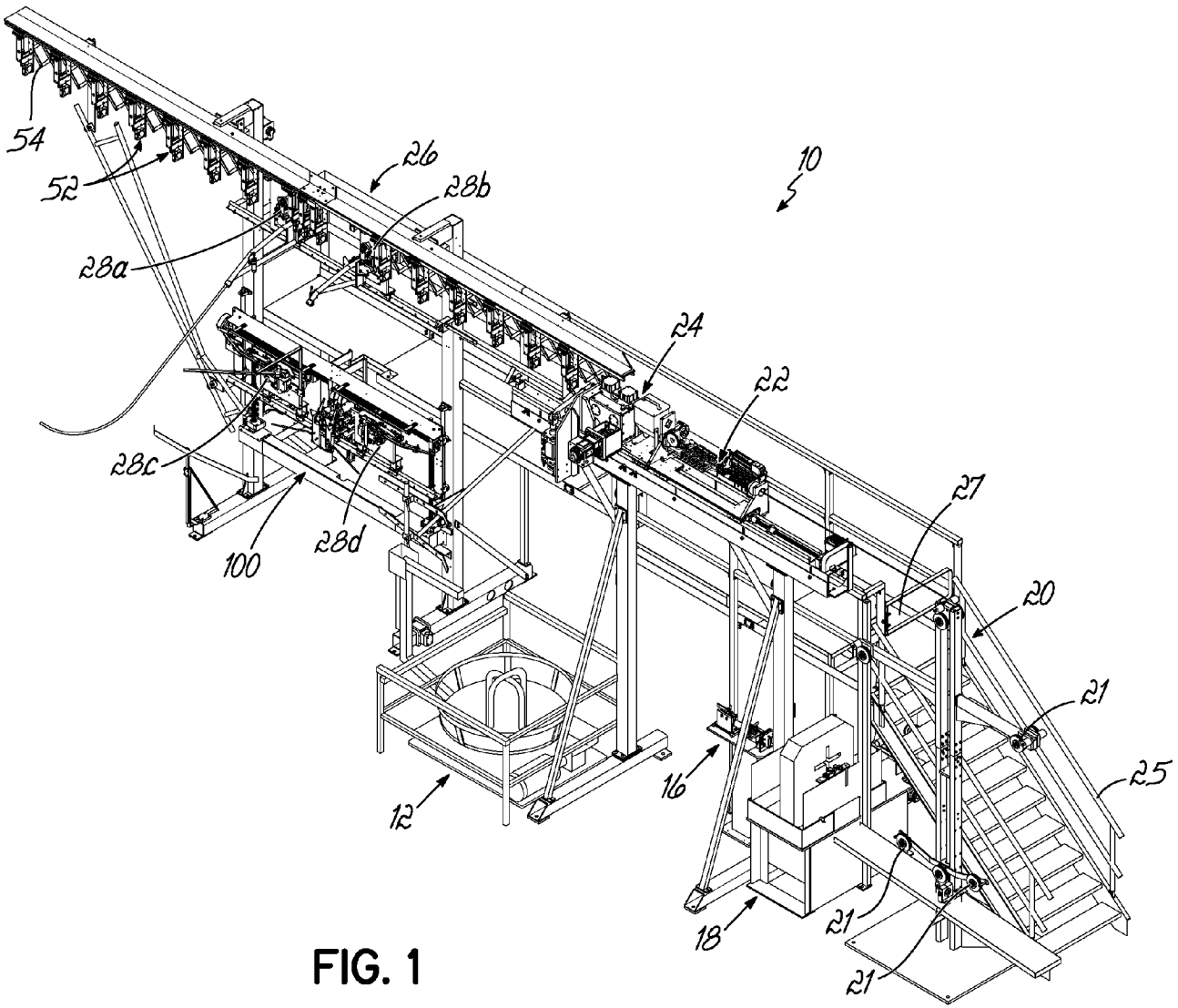
FIG. 1 is a perspective view of one embodiment of the apparatus of the present invention.

Referring to the figures, and particularly to FIG. 1, an apparatus for making a border wire having a rectangular cross-section is generally indicated by the numeral 10. The apparatus 10 comprises a wire payoff 12 for unwinding wire having a round cross-section 13 from a spool 14 of wire (shown in FIG. 1A).

Downstream of the wire payoff 12 is a two-plane wire straightener 16.

Downstream of the two-plane wire straightener 16 is a metal forming machine 18 which changes the cross-sectional configuration of the wire 13 from a round cross-section to a rectangular cross-section. This type of metal forming machine 18 is known in the industry as a Turks Head. One suitable Turks Head is available from the FENN division of SPX Precision Components based in Newington, Conn. The wire having the rectangular cross-section is denoted by the number 19 in the drawings.

A wire accumulator 20 is located at one end of the apparatus 10 downstream of the metal forming machine 18. The wire accumulator 20 has a plurality of spaced rollers 21 around which the wire having the rectangular cross section 19 passes.

A three-axis straightener 22, such as the one disclosed in U.S. patent application Ser. No. 13/179,039, fully incorporated by reference herein, is located downstream of the wire accumulator 20. The details of the three-axis straightener 22 are shown in FIGS. 2A and 2B.

A feed assembly 24, including feed rollers 43 driven by a servo motor 42, is located downstream of the three-axis straightener 22. The feed assembly 24, or feeder, measures a predetermined length of wire which passes therethrough before being cut. The details of the feed assembly 24 are shown in FIGS. 2A, 2B and 2C.

Figure 7:
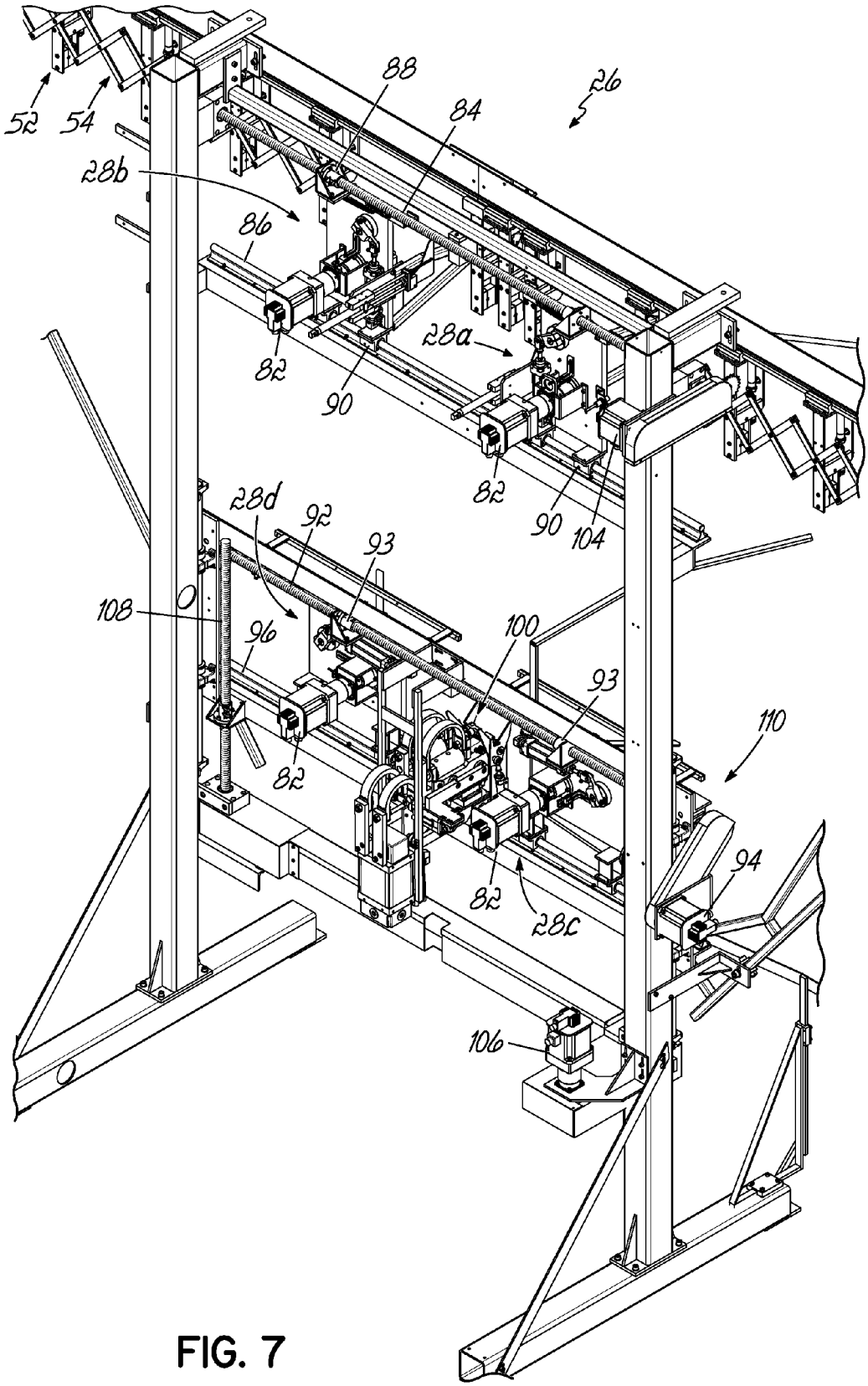
FIG. 7 is a rear perspective view of a portion of the apparatus of FIG. 1.

A bender section 26, comprising four bending assemblies 28*a*-28*d*, is located downstream of the feed assembly 24. Upper bending assemblies 28*a* and 28*b* are located above lower bending assemblies 28*c* and 28*d*, respectively. As best shown in FIG. 7, each bending assembly 28*a*-28*d* is driven by a servo motor 82, which may be independently programmed.

A welder unit 100 is located between the lower bending assemblies 28*c* and 28*d*. The details of the welder unit 100 are shown in FIGS. 6, 6A, 6B and 6C.

Lastly, a catwalk 27 is part of the apparatus and has a ladder 25 at one end to enable a person to walk up to the catwalk 27.

Figure 1A:
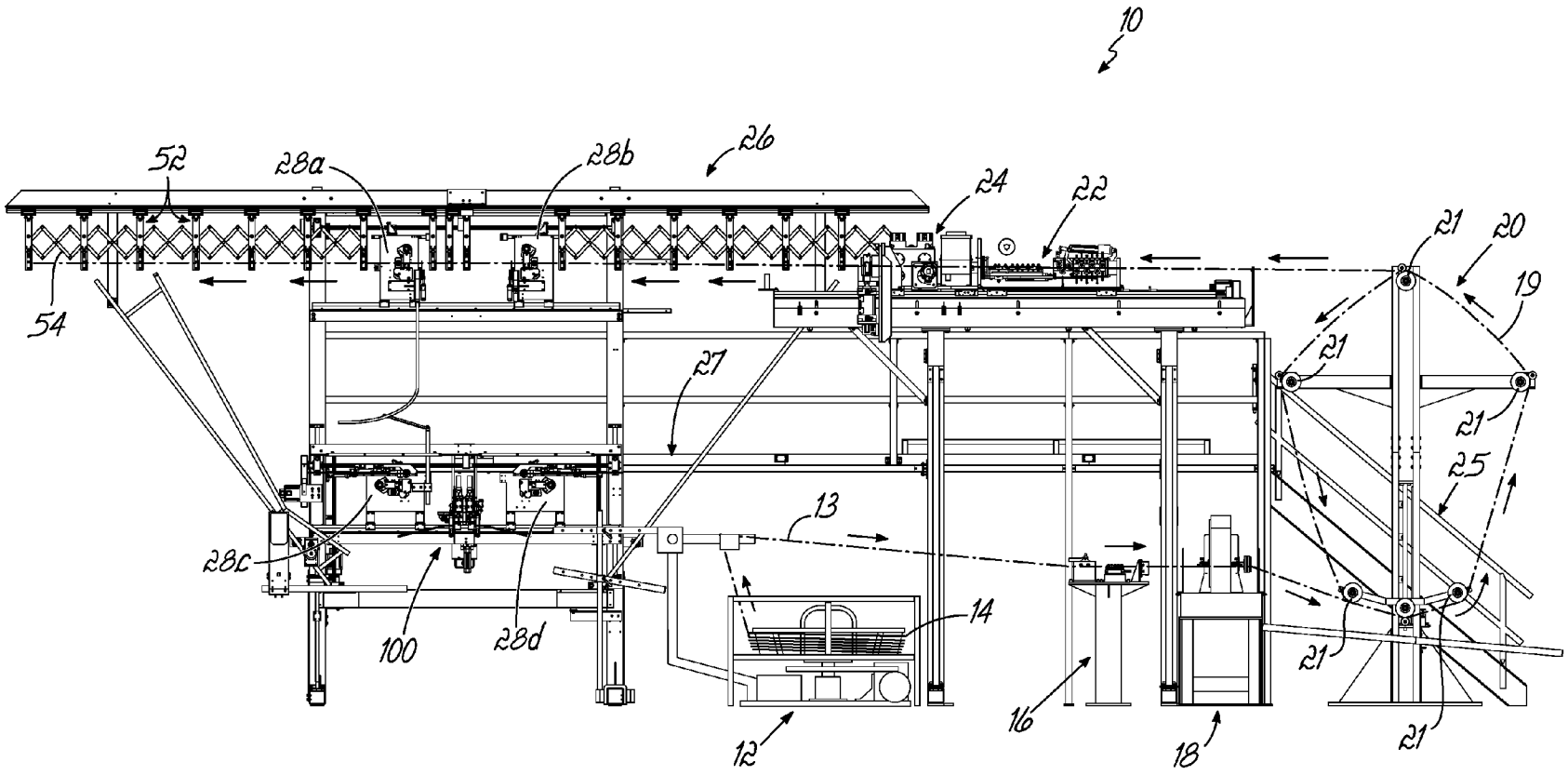
FIG. 1A is a side elevational view of the apparatus of FIG. 1, the path of wire travel being partially shown.
Figure 1B:
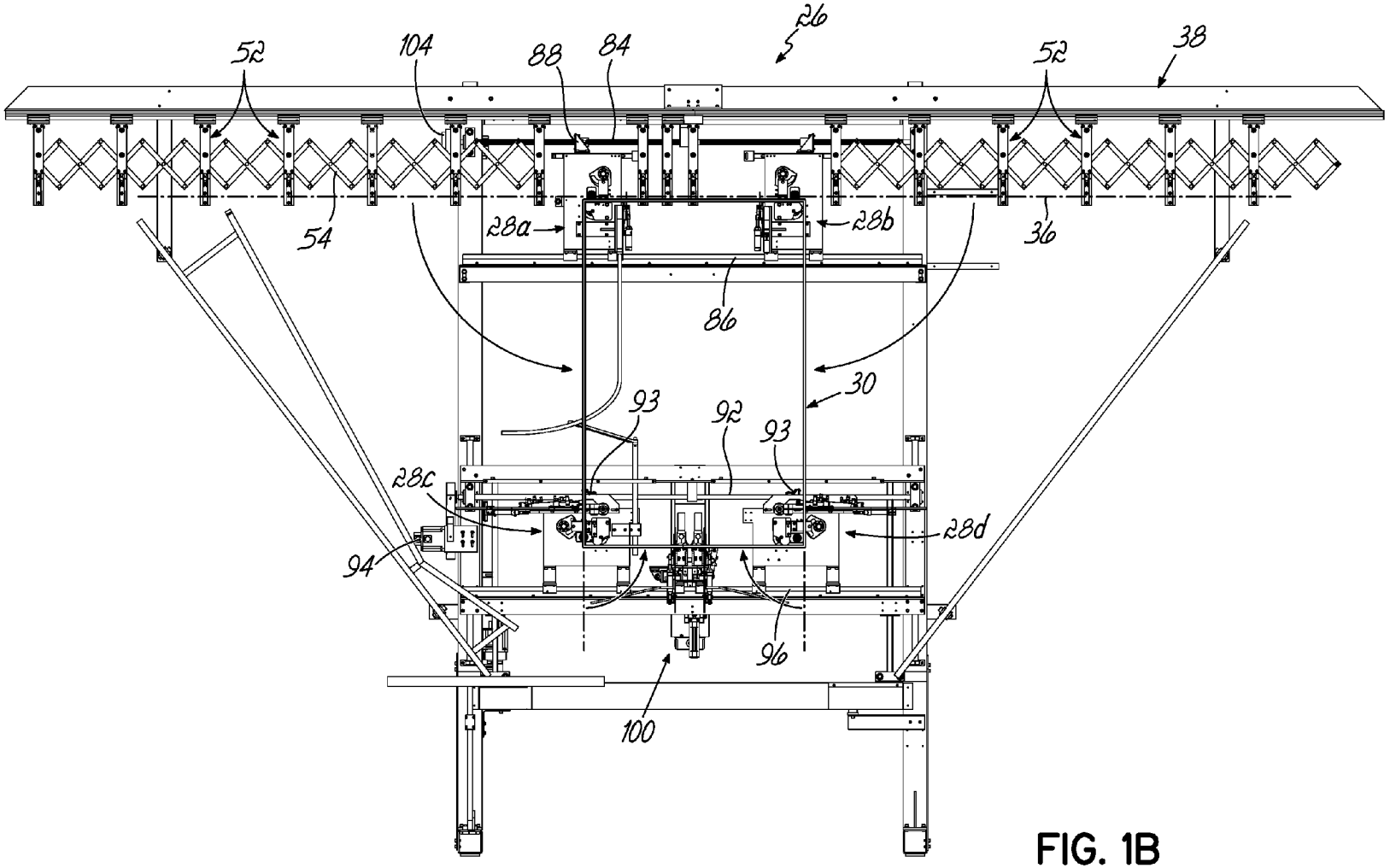
FIG. 1B is a side elevational view of a portion of the apparatus of FIG. 1, the bending of wire being shown.

The drawings, and, in particular, FIGS. 1A and 1B, illustrate the method of making a border wire 30 having a rectangular cross-section. As shown in FIG. 1A, a spool of wire 14 having a circular cross-section is unwound using the wire payoff 12. The unwound wire 13 is passed through the two-plane wire straightener 16 and then though the metal forming machine 18, which changes the cross-sectional configuration of the wire 13 from a round cross-section to a rectangular cross-section. The wire 19 having a rectangular cross-section is then accumulated in wire accumulator 20. The wire 19 passes around the rollers 21 of the wire accumulator 20. Wire accumulator 20 allows enough wire to build up or accumulate therein so that during the border feed process, the metal forming machine 18, or Turks Head, is seldom, if ever, required to stop operating during production. A lower portion of wire accumulator 20 may move vertically during operation to adjust the amount of wire in the wire accumulator 20. In practice, the wire 19 may pass around the wire accumulator 20 twice to create two loops around the outside of rollers 21.

The wire 19, having a rectangular cross-section, is then pulled through the three-axis straightener 22 by the feed assembly 24. The feed assembly 24 measures the desired length of wire 19 and cuts it to length to obtain a piece of wire 36 shown in FIG. 1B.

The piece of wire 36 having a rectangular cross-section is supported by a support 38, which may be adjusted in length. The piece of wire 36 is then bent from a straight piece into a rectangular configuration by multiple bender assemblies 28*a*-28*d* in the bender section 26. Upper bending assemblies 28*a* and 28*b* bend the piece of wire 36 into a generally inverted U-shape. Each upper bending assembly 28*a*, 28*b* bends the piece of wire 36 into a 90 degree or right angle. Then, each lower bending assembly 28*c*, 28*d*, bends the piece of wire 36 into a 90 degree or right angle. Lastly, opposed ends of the piece of wire 36 are welded together using the welding unit 100 to complete the rectangle of the border wire 30, as shown in FIG. 1B.

Figure 2:
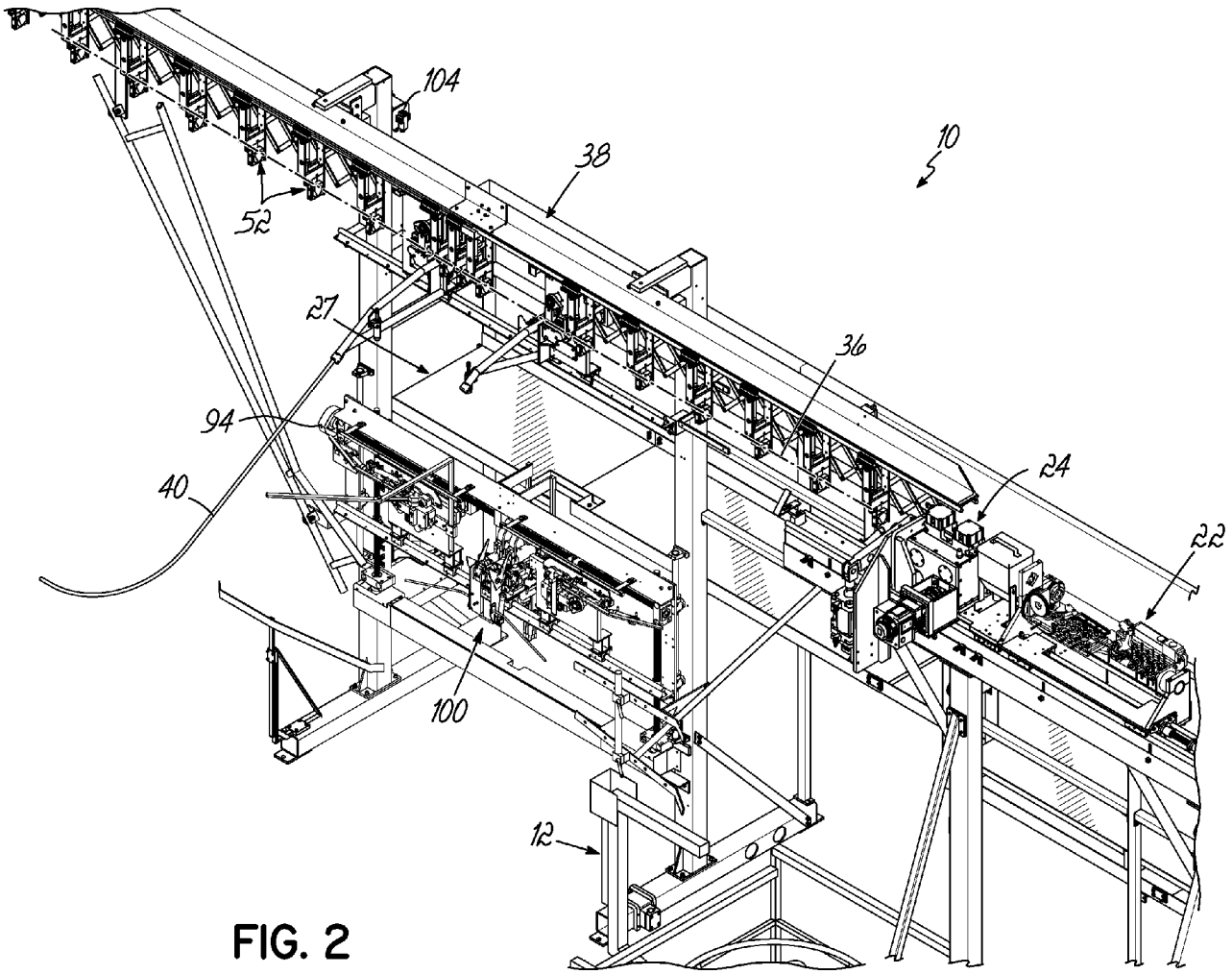
FIG. 2 is an enlarged perspective view of a portion of the apparatus of FIG. 1.
Figure 2A:
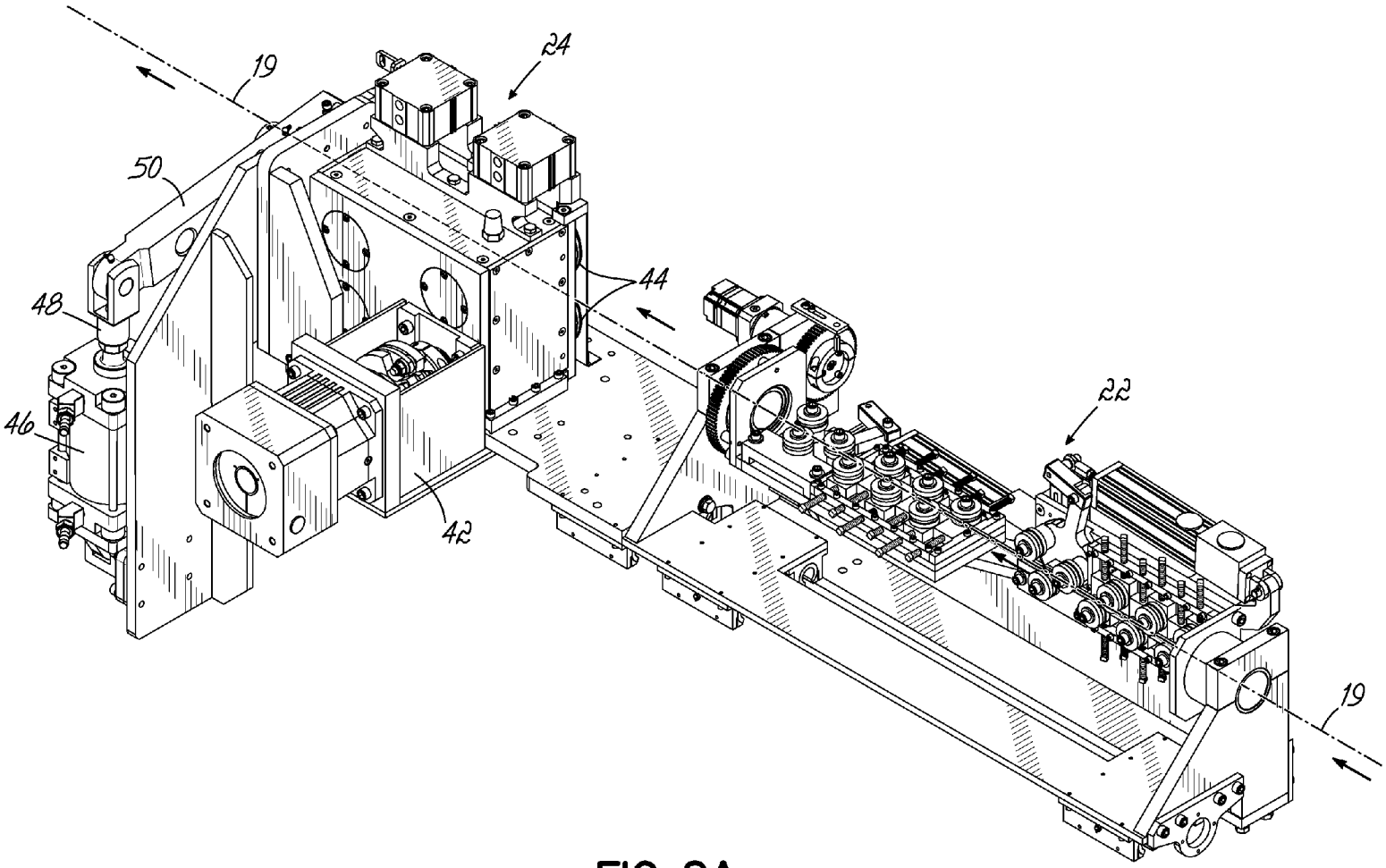
FIG. 2A is an enlarged perspective view of a portion of the apparatus shown in FIG. 2.
Figure 2B:
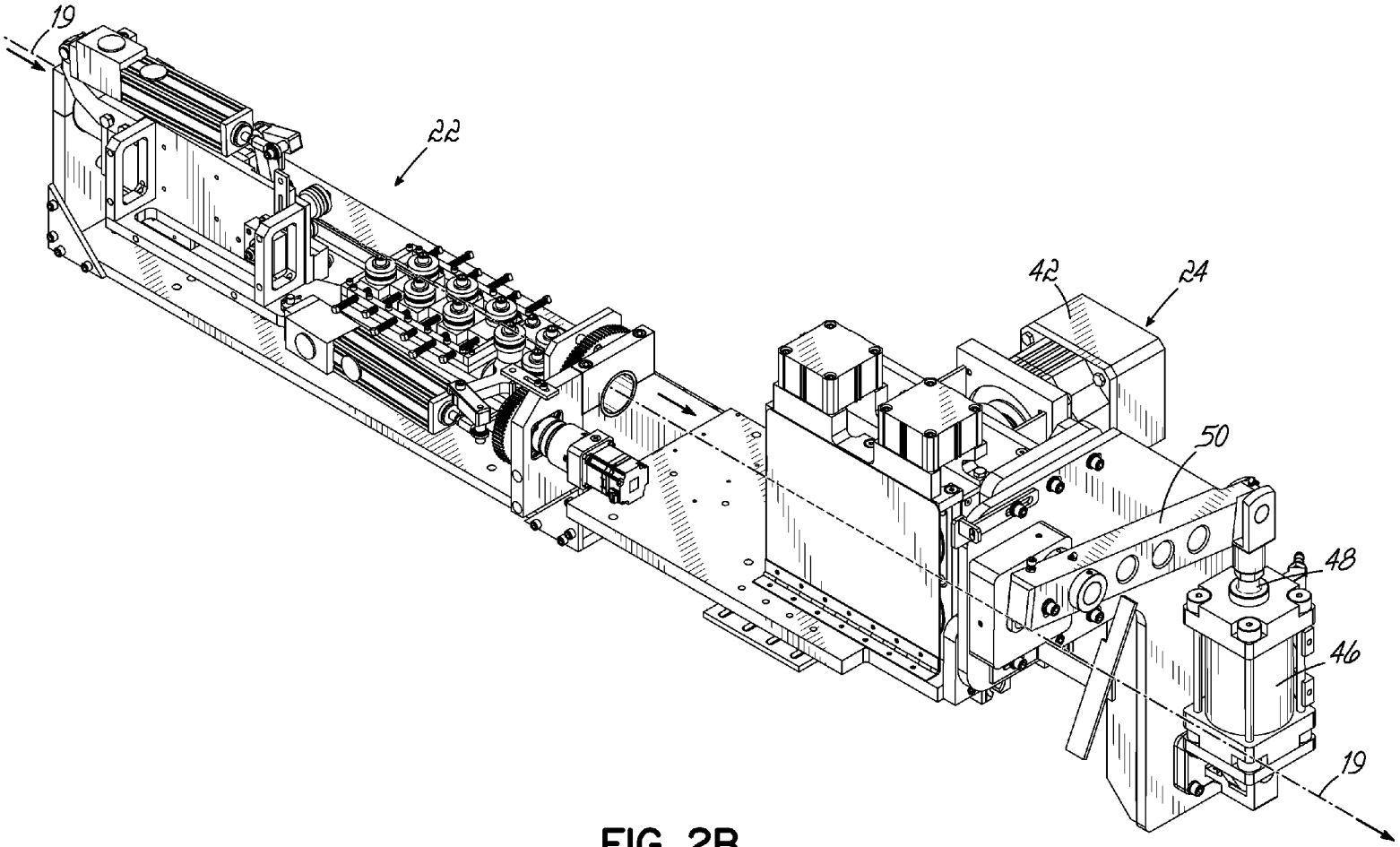
FIG. 2B is an enlarged perspective view of a portion of the apparatus shown in FIG. 2.
Figure 2C:
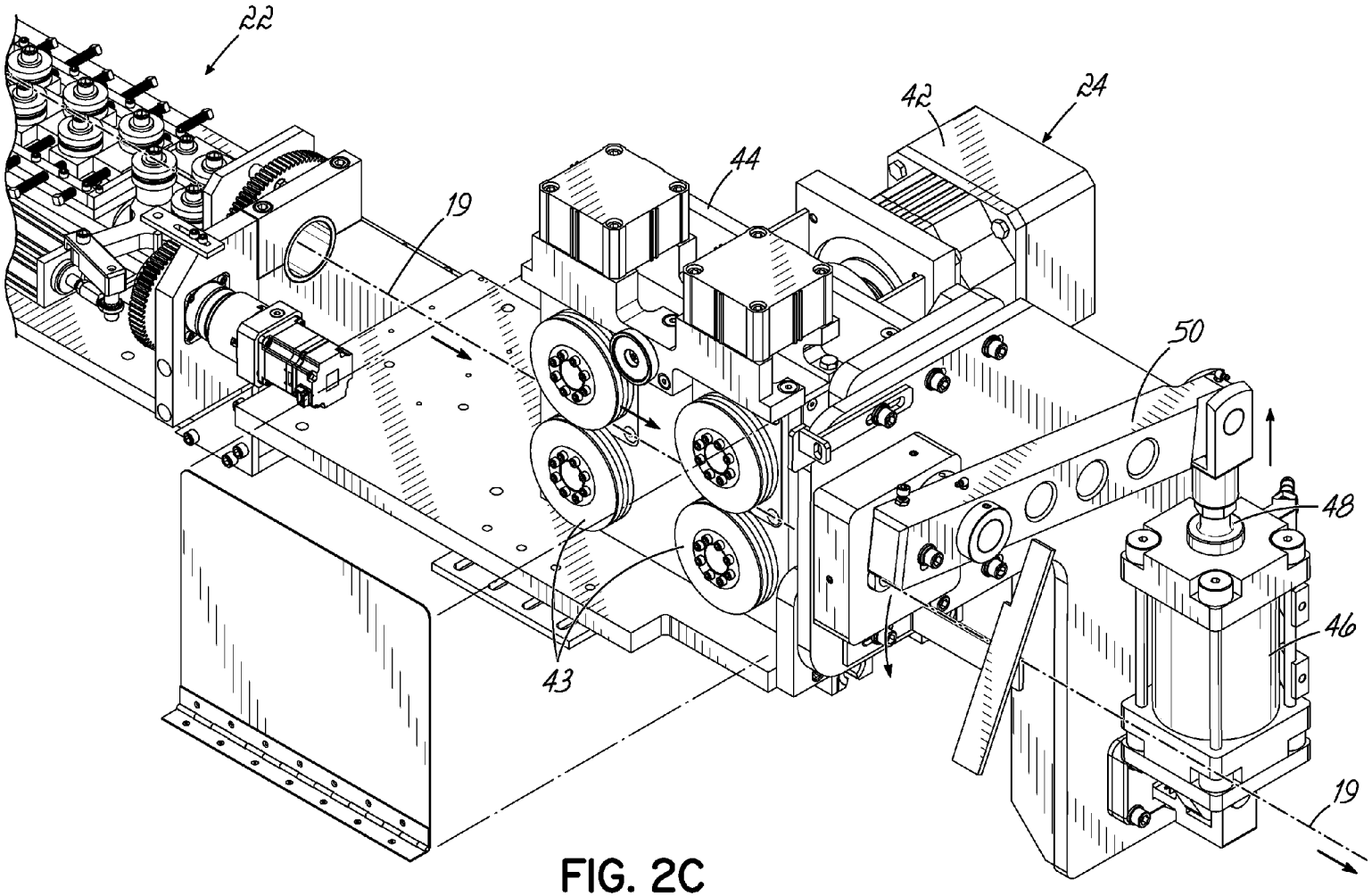
FIG. 2C is an enlarged perspective view of a portion of the apparatus shown in FIG. 2.
Figure 8:
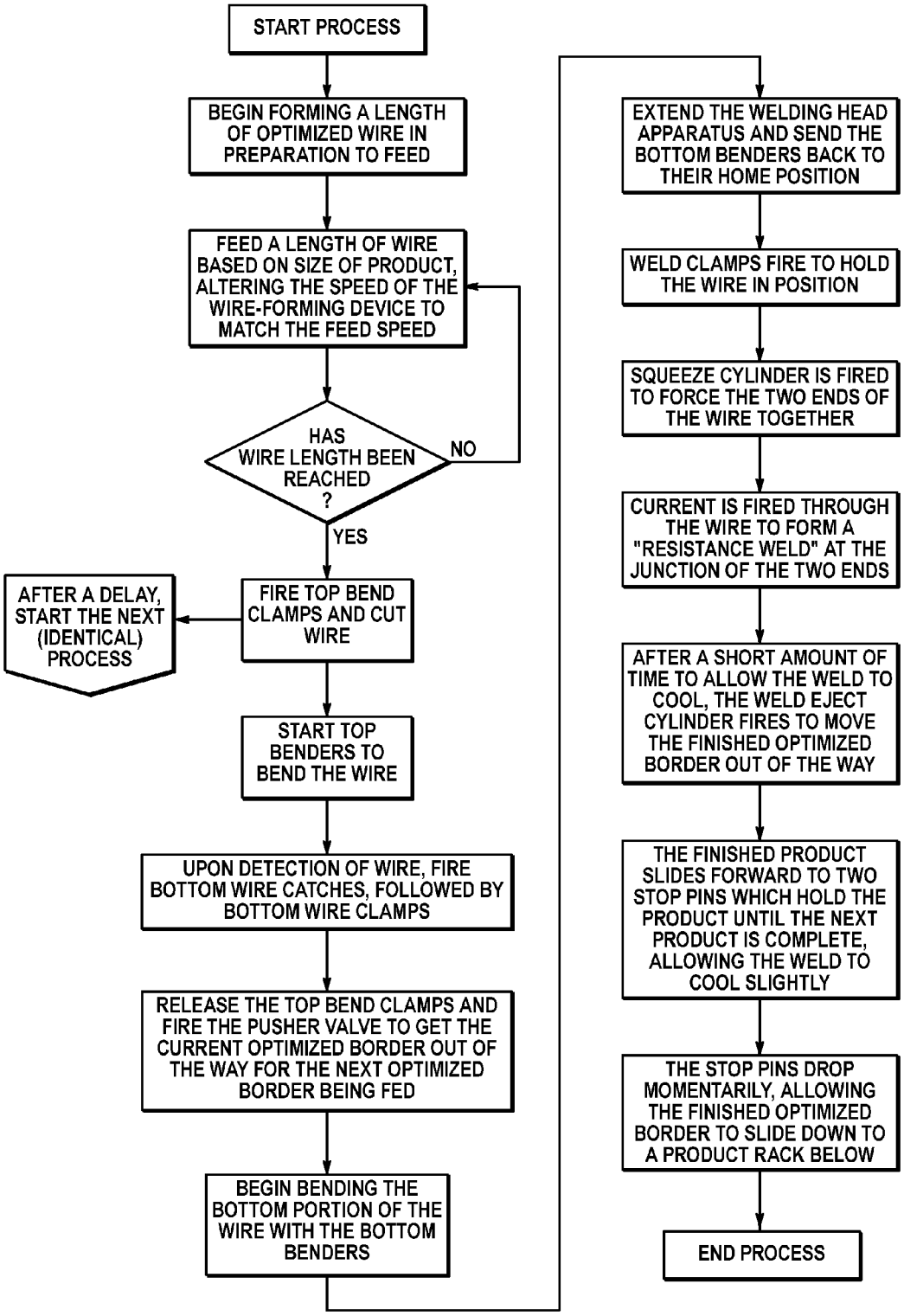
FIG. 8 shows a flow chart of the operation of the apparatus.

FIG. 2 illustrates an enlarged portion of the apparatus 10. A wire guide 40 extends outwardly from a portion of the support 38. The wire guide 40 guides the finished border wires 30 onto a movable member (not shown) for transport. More specifically, the wire guide 40 extends forwardly from one of two holders 112 (the holder 112 on the left of FIG. 3). Each holder 112 has a movable stop pin 114 driven by a cylinder, referenced in the flow chart of FIG. 8. The welded, completed border wire 30 is held in place for a moment using the stop pins 114 to allow the weld to cool before the border wire 30 is moved down the wire guide 40 to a product rack (not shown).

FIG. 2A illustrates an enlarged view of the three-axis straightener 22 and the feed assembly 24. The feed assembly 24 is driven by a servo motor 42, which causes rotation of rollers or pullers 43 inside encasement 44, best shown in FIG. 2C. A piston 46 raises a rod 48 causing a cutter 50 to cut the wire 19 at the desired location. See FIGS. 2B and 2C.

Figure 3:
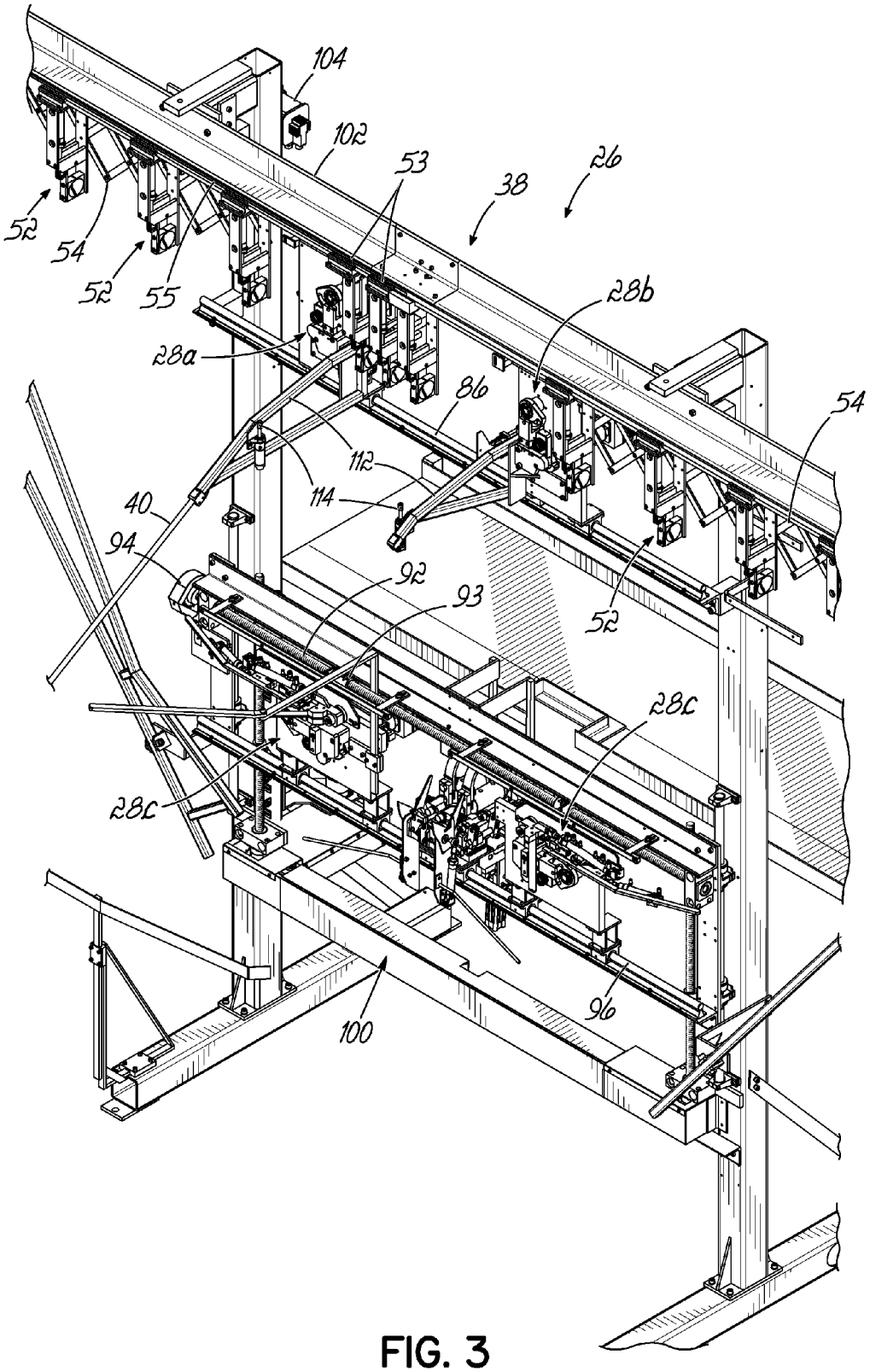
FIG. 3 is an enlarged perspective view of a portion of the apparatus shown in FIG. 2.
Figure 3A:
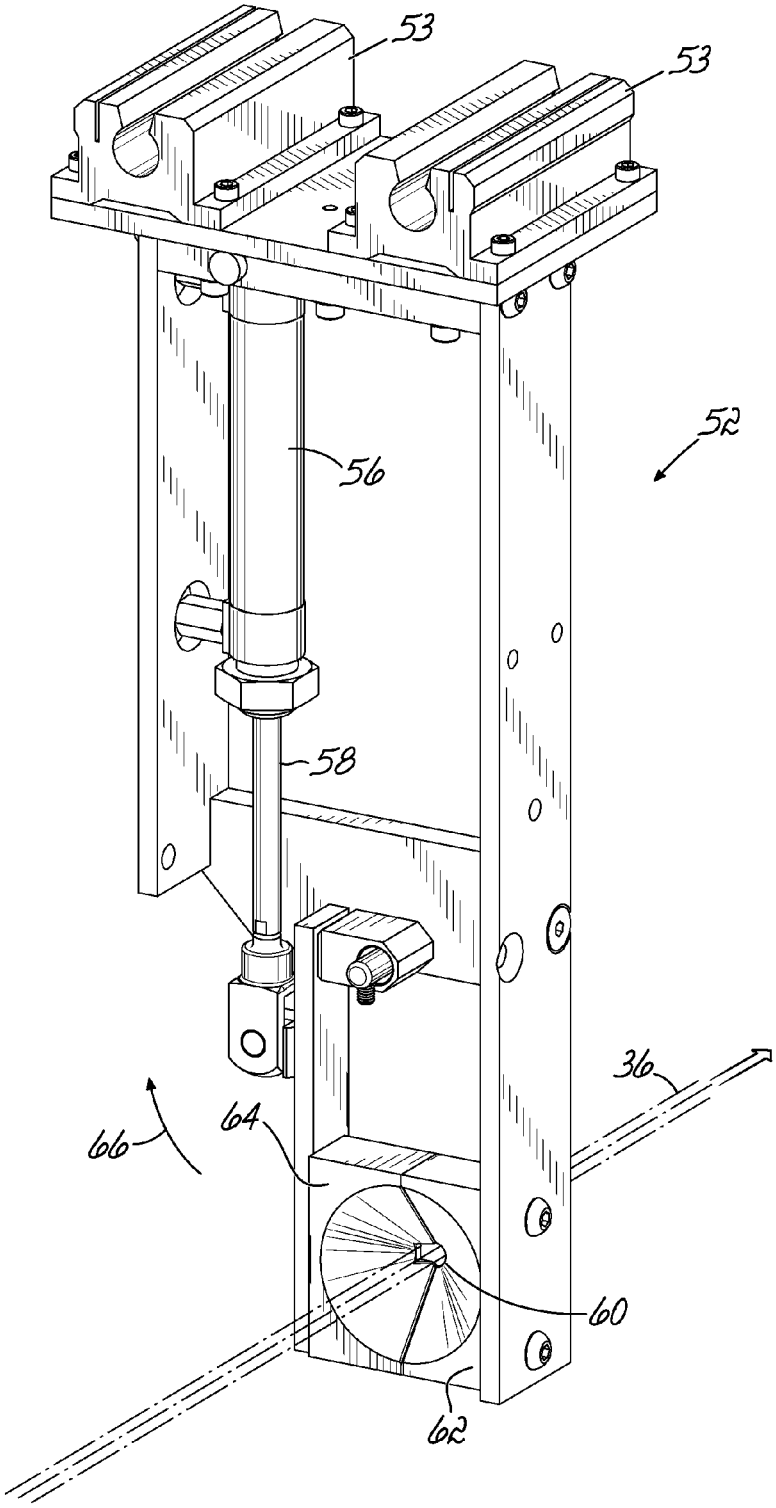
FIG. 3A is an enlarged perspective view of a portion of the apparatus shown in FIG. 3.
Figure 3B:
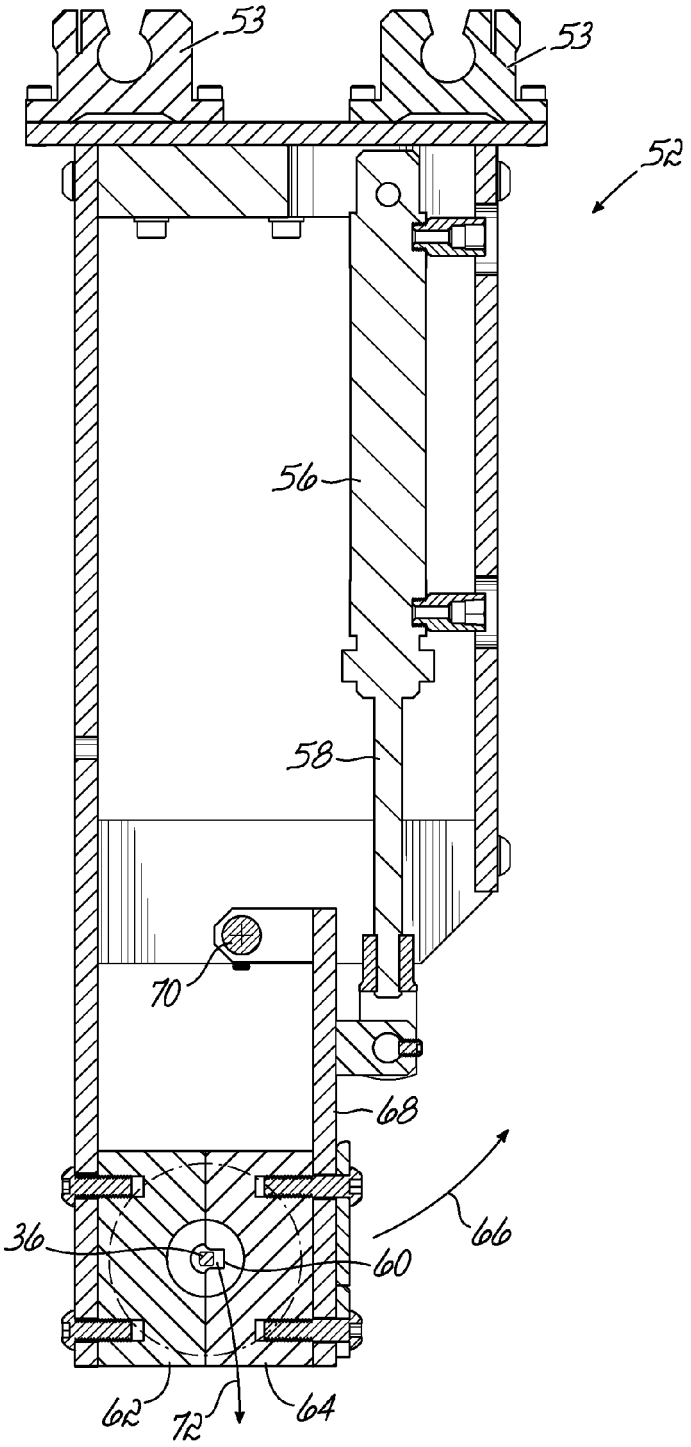
FIG. 3B is a cross-sectional view of the portion of the apparatus shown in FIG. 3A.

FIG. 3 illustrates a closer view of a portion of the wire support 38. The wire support 38 comprises a stationary horizontal member 102 and a plurality of support member assemblies 52, one of which is illustrated in FIG. 3A. As shown in FIGS. 3 and 3D, accordion-like or scissors-like adjusters 54 enable the support member assemblies 52 outside the upper bending assemblies 28*a*, 28*b* to move closer together or further apart. As best shown in FIG. 3D, each adjuster 54 connects a plurality of support member assemblies 52, the guides 53 of the support member assemblies 52 moving along rails 55 of the stationary horizontal member 102 of wire support 38.

As illustrated in the drawings and described below, rotation of an upper drive rod 84 by a servo motor 104 (seen in FIG. 3) causes movement of the two upper bending assemblies 28*a*, 28*b* during the set-up procedure. Because at least one of the support member assemblies 52 is connected to each of the upper bending assemblies 28*a*, 28*b*, movement of the upper bending assemblies 28*a*, 28*b* causes movement of the accordion-like or scissors-like adjusters 54 to accommodate different wire lengths. Upper bending assembly 28*a* is connected to one of the support member assemblies 52 and, therefore, one of the accordion-like or scissors-like adjusters 54 (the one on the left as shown in the drawings). Similarly, upper bending assembly 28*b* is connected to one of the support member assemblies 52 and, therefore, one of the accordion-like or scissors-like adjusters 54 (the one on the right as shown in the drawings). Because the upper drive rod 84 has threads going in opposite directions (left and right hand threads), rotation of the upper drive rod 84 causes the upper bending assemblies 28*a*, 28*b* along with the attached adjusters 54 to move in opposite directions (apart or together), depending on the size of border wire desired to be produced.

FIG. 3A illustrates a support member assembly 52 having a cylinder 56, which moves a rod 58 in order to drop the wire 19 from inside a passage 60. The passage 60 is defined between two blocks 62, 64. Block 62 is stationary, and block 64 is movable. As shown by arrow 66 in FIGS. 3A and 3B, a movable section 68 of the support member assembly 52 pivots about a pivot axis 70 when the rod 58 is pulled upwardly by the cylinder 56. When the movable section 68 of support member assembly 52 is pivoted about axis 70 to a raised position in multiple support member assemblies 52, the piece of wire 36 having a rectangular cross-section drops downwardly, as shown by arrow 72 of FIG. 3B. Of course, the movable section 68 of support member assembly 52 may be pivoted about axis 70 to a lowered position in multiple support member assemblies 52, in order to lock the piece of wire 36 having a rectangular cross-section in place.

Figure 3C:
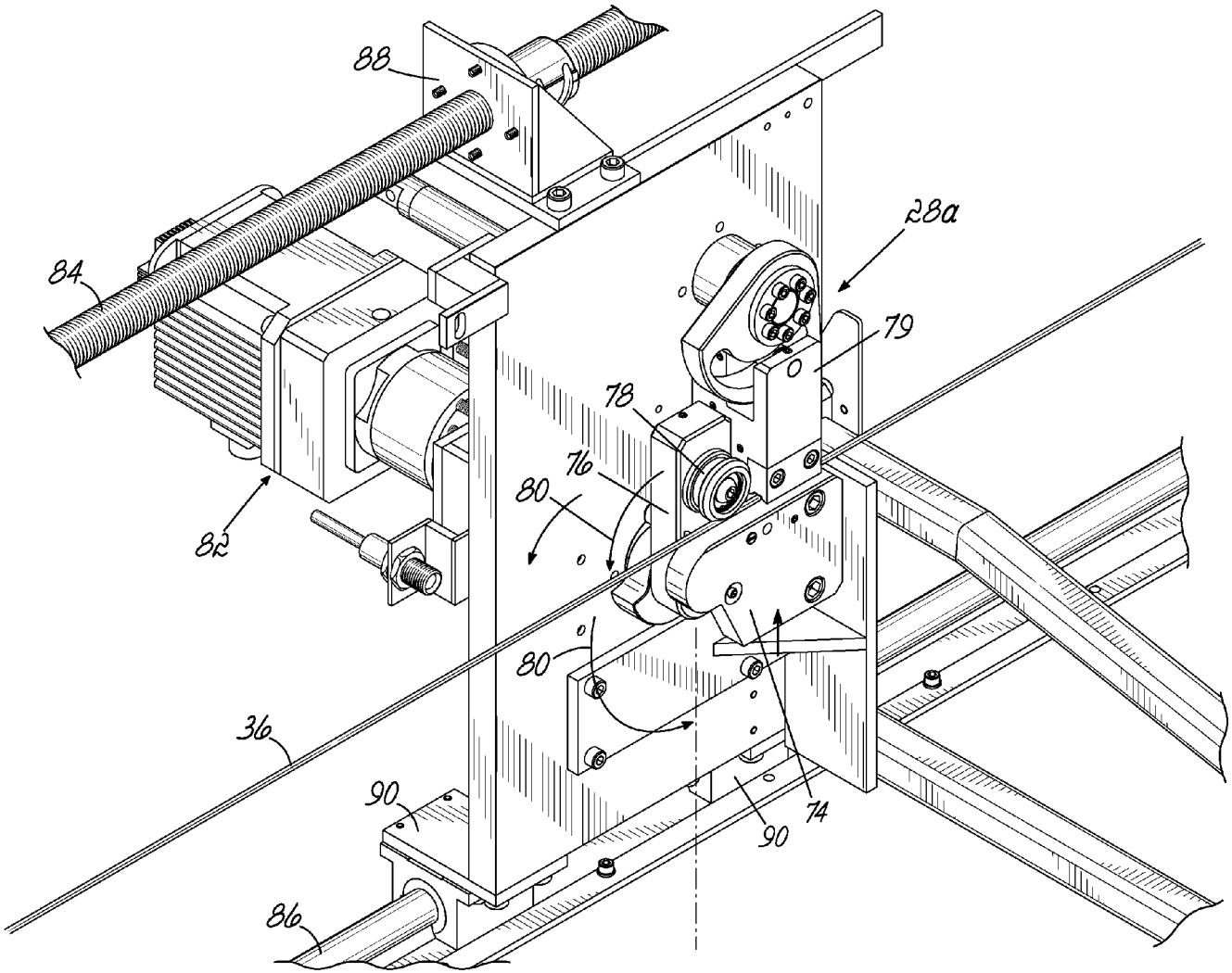
FIG. 3C is an enlarged perspective view of a portion of the apparatus shown in FIG. 3.
Figure 3D:
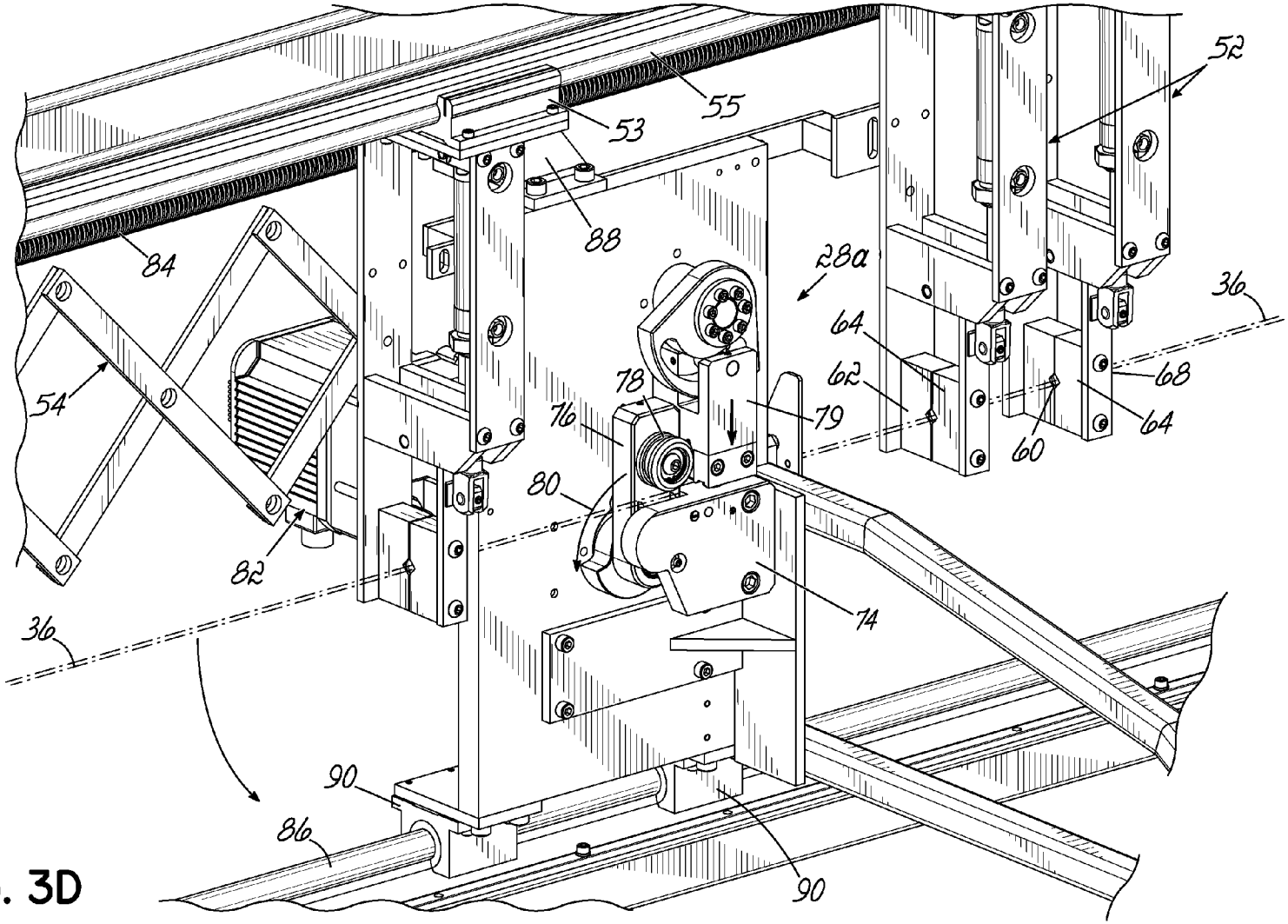
FIG. 3D is an enlarged perspective view of a portion of the apparatus shown in FIG. 3.
Figure 3E:
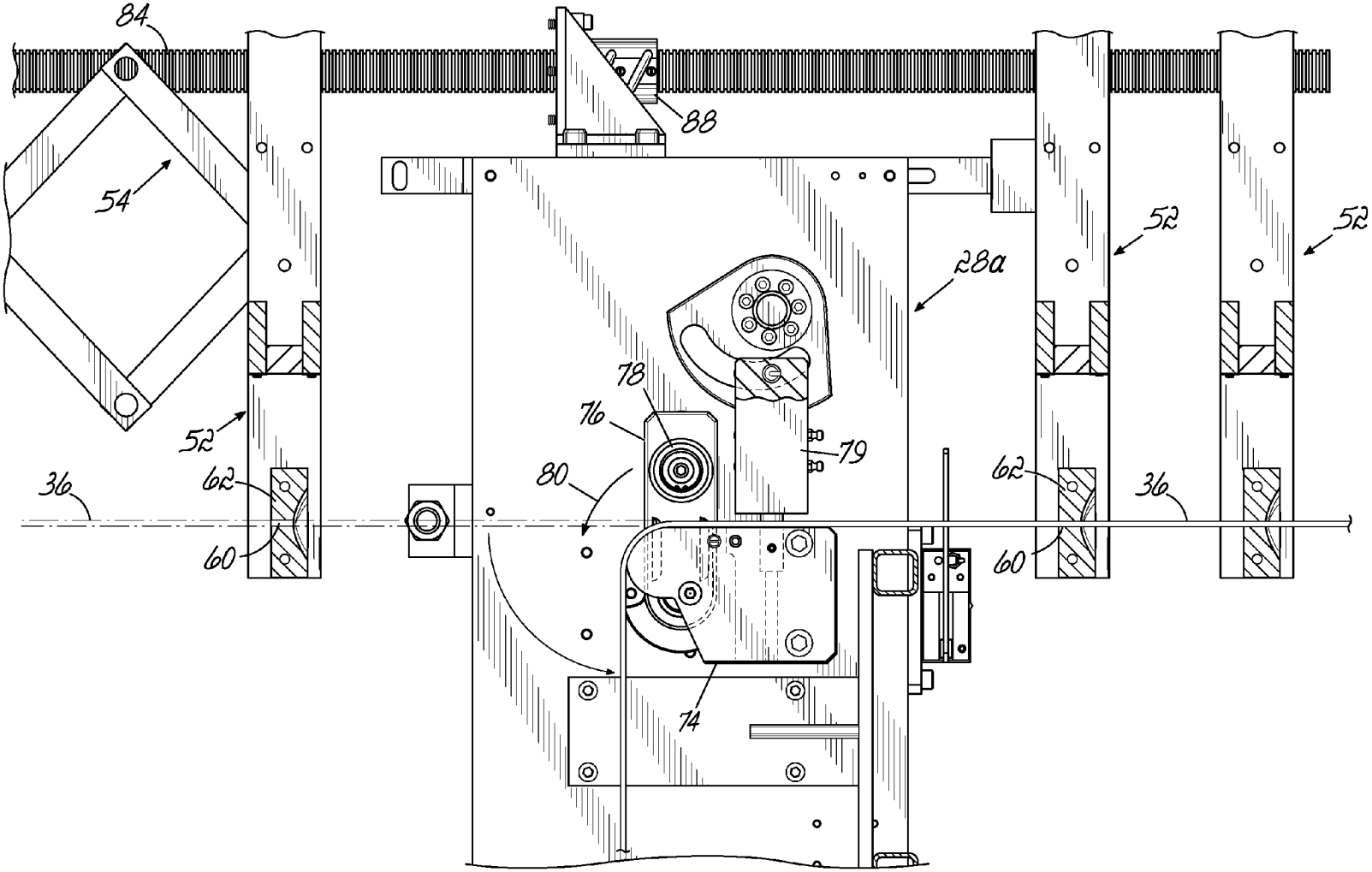
FIG. 3E is an enlarged perspective view of a portion of the apparatus shown in FIG. 3.

FIGS. 3C, 3D and 3E illustrate bending assembly 28*a*. Each of the bending assemblies has the same parts, but they are oriented differently. Bending assembly 28*a* comprises a stationary radial die 74 and a movable bender subassembly 76, including a roller 78 which moves in the direction of arrows 80 (counterclockwise). The bender subassembly 76 is driven by a servo motor 82. After the piece of wire 36 is clamped in place with clamp 79, the roller 78 engages the piece of wire 36 and bends it 90 degrees around stationary radial die 74. FIG. 3D also illustrates several of the support member assemblies 52, the piece of wire 36 being shown in phantom.

The wire 19 goes through the feeder 24 that feeds the programmed amount of wire for a select product code. At this point, the wire will be cut using cutter 50 just after the wire 19 is clamped at the upper bending assemblies 28*a*, 28*b*. As the wire goes through the feeder 24, it is fed through the guides that help insure it follows the correct path and goes through each of the two upper bending assemblies 28*a*, 28*b*. Once the correct length is reached and the wire is through both of the upper bending assemblies 28*a*, 28*b*, it is clamped and then cut using cutter 50. The bending heads 78 then bend the wire around the radial dies 74; bending continues on so that the wire is fed into the lower bending assemblies 28*c*, 28*d*. As the upper dies complete their bend of the wire, the wire is clamped into the lower bending dies and then bent again so that the wire has taken the "border" shape of the product code required. After the lower bending assemblies 28*c*, 28*d* have completed bending the wire, the ends of the wire are placed into the welding unit or welding head. Once in the welding head, the weld clamps close to hold the wire, and "squeeze" cylinders fire to force the two ends together while simultaneously firing current through the wire and forming a "butt weld" at the junction of the two ends. During this process, the upper dies release the wire and "pushers" fire to push the wire out of the path of the next oncoming wire, so the process may repeat. Once welded, the weld ejects fire to also push the now finished product out of the way of the next incoming wire from the upper bending assemblies. The finished product slides forward to two stop pins, which hold the product until the next product is complete, allowing the weld to cool slightly before releasing it to slide down the wire guide 40 to a product rack (not shown).

FIG. 3C shows bending assembly 28*a* movable on a rotatable threaded upper drive rod 84 driven by a servo motor 104 (shown in FIG. 1B). The drive rod 84 also passes through an upper block 88 of bending assembly 28*b* in the same fashion. A guide rail 86 passes through bottom blocks 90 of bending assembly 28*a*, as shown in FIG. 3C. The same is true for bending assembly 28*b*. Thus, rotation of upper drive rod 84 moves the bending assemblies 28*a*, 28*b* closer together or further apart depending upon the direction of rotation of the drive rod 84.

Figure 4:
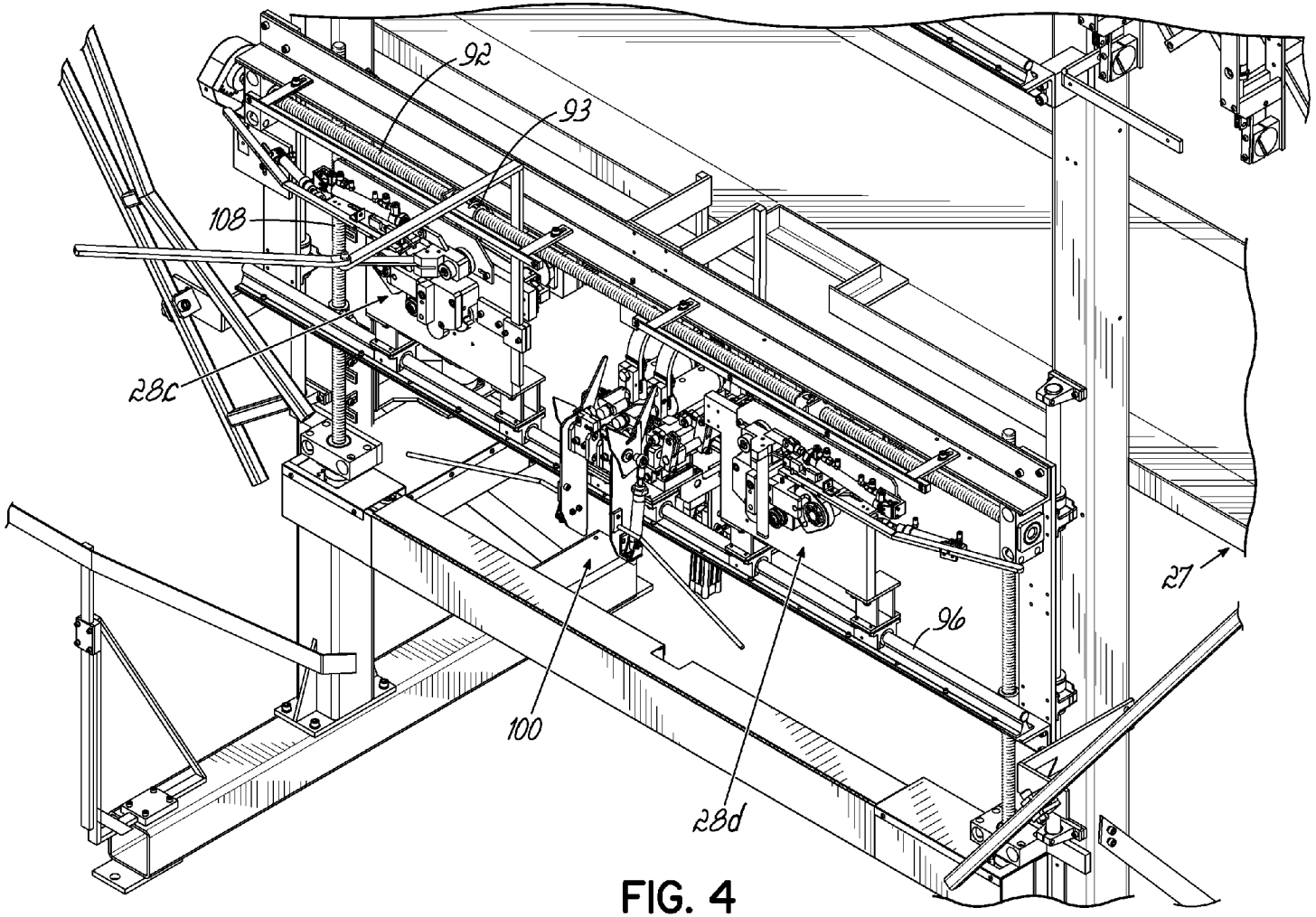
FIG. 4 is an enlarged perspective view of a portion of the apparatus shown in FIG. 2.

FIG. 1B shows bending assembles 28*c*, 28*d* movable on a rotatable threaded drive rod 92 driven by a servo motor 94 in the same manner. In the same manner shown in FIG. 3B with respect to upper bending assembly 28*a*, drive rod 92 passes through an upper block 93 of each lower bending assembly 28*c*, 28*d* in the same fashion. Similarly, a guide rail 96 passes through bottom blocks 98 of each lower bending assembly 28*c*, 28*d*, as shown in FIG. 4. Thus, rotation of drive rod 92 moves the lower bending assemblies 28*c*, 28*d* closer together or further apart depending upon the direction of rotation of the drive rod 92. Because the lower drive rod 92, like upper drive rod 84, has threads going in opposite directions (left and right hand threads), rotation of the lower drive rod 92 causes the lower bending assemblies 28*c*, 28*d* to move in opposite directions (apart or together), depending on the size of border wire desired to be produced.

Figure 5:
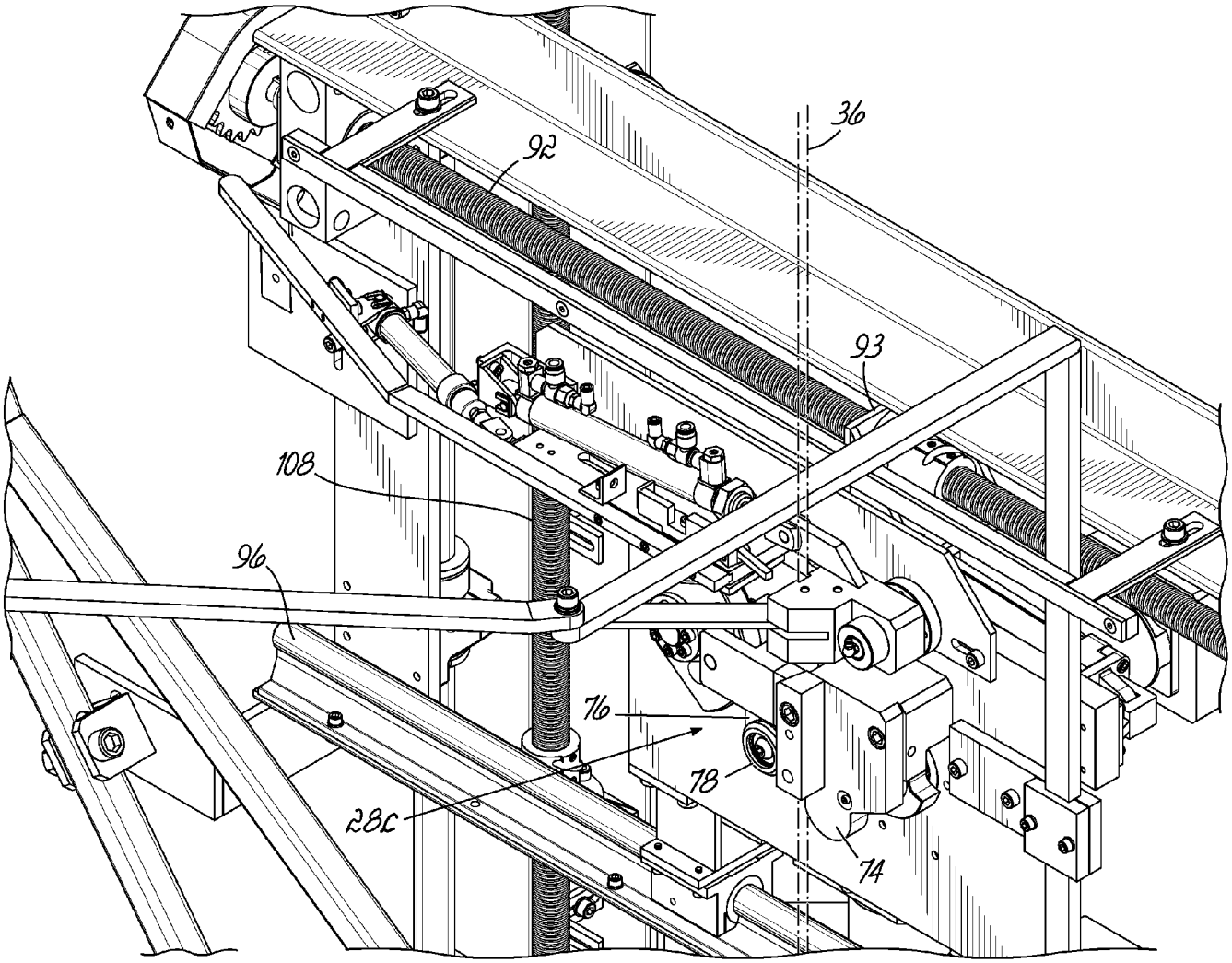
FIG. 5 is an enlarged perspective view of a portion of the apparatus shown in FIG. 4.
Figure 5A:
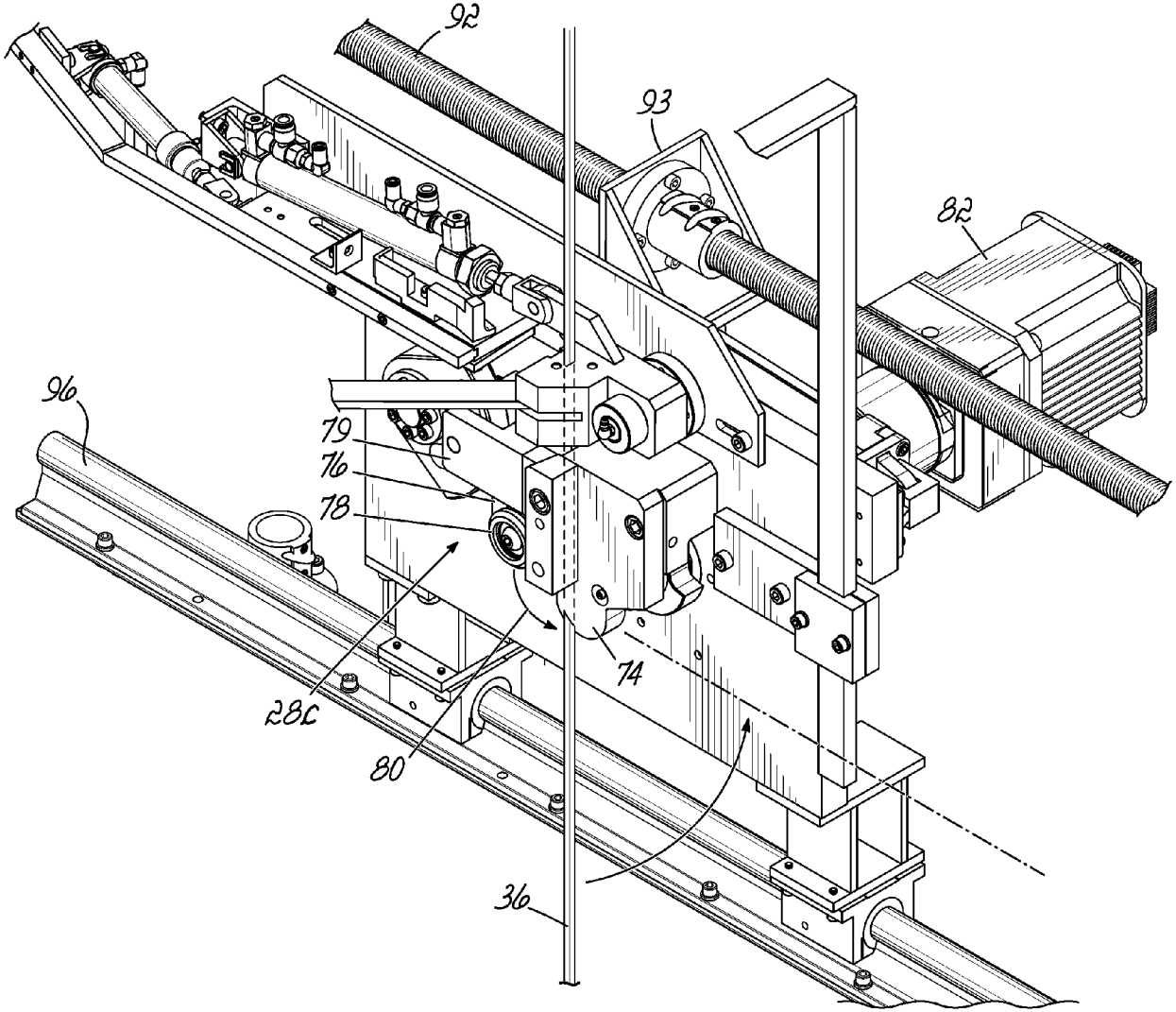
FIG. 5A is an enlarged perspective view of the portion of the apparatus shown in FIG. 5.
Figure 5B:
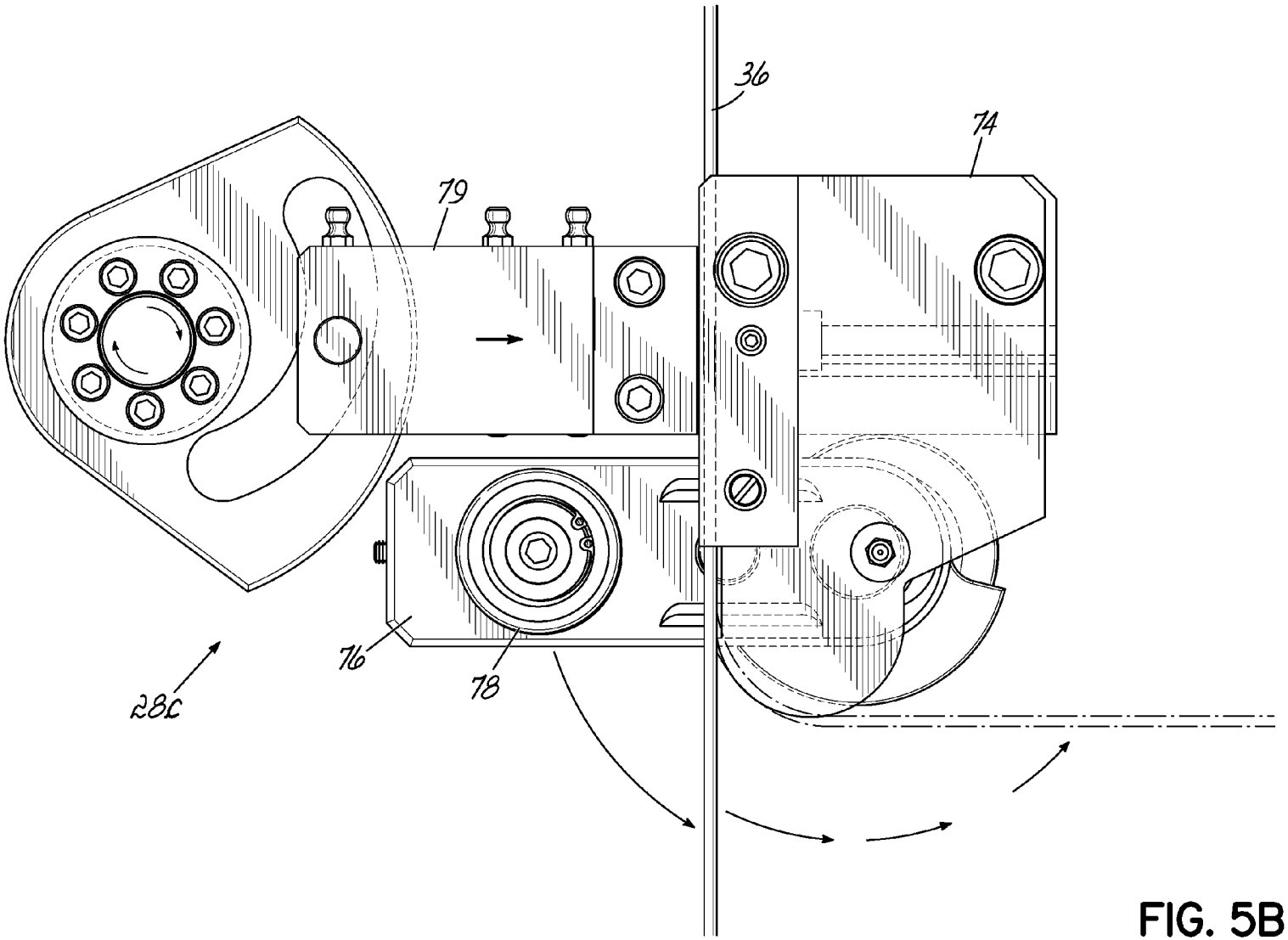
FIG. 5B is an enlarged perspective view of a portion of the apparatus shown in FIG. 5.

FIG. 4 illustrates the bottom bending assemblies 28*c* and 28*d* along with the welding unit 100. FIGS. 5, 5A and 5B illustrate enlarged views of the bending assembly 28*c*.

Figure 6:
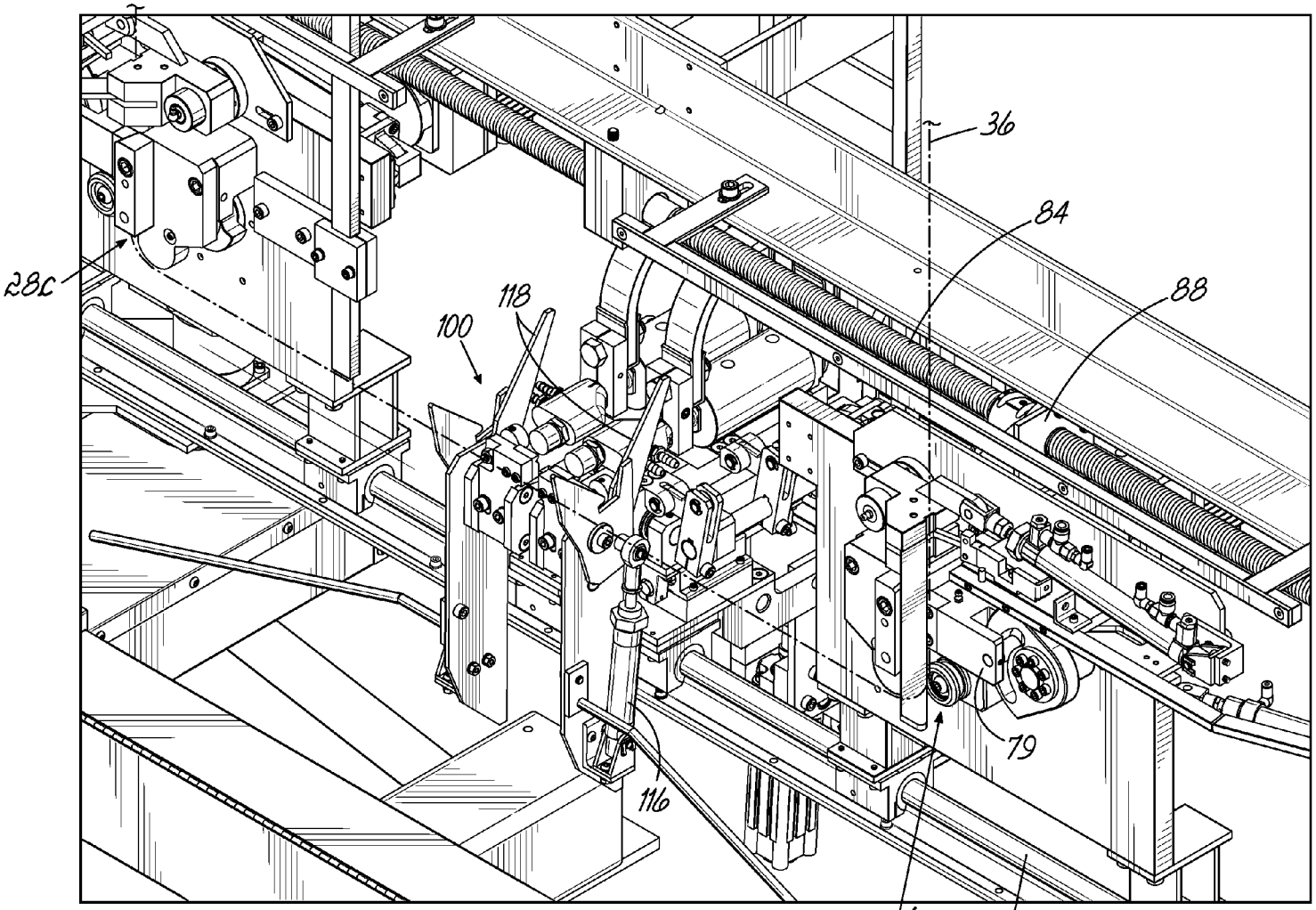
FIG. 6 is an enlarged perspective view of a portion of the apparatus shown in FIG. 3.
Figure 6A:
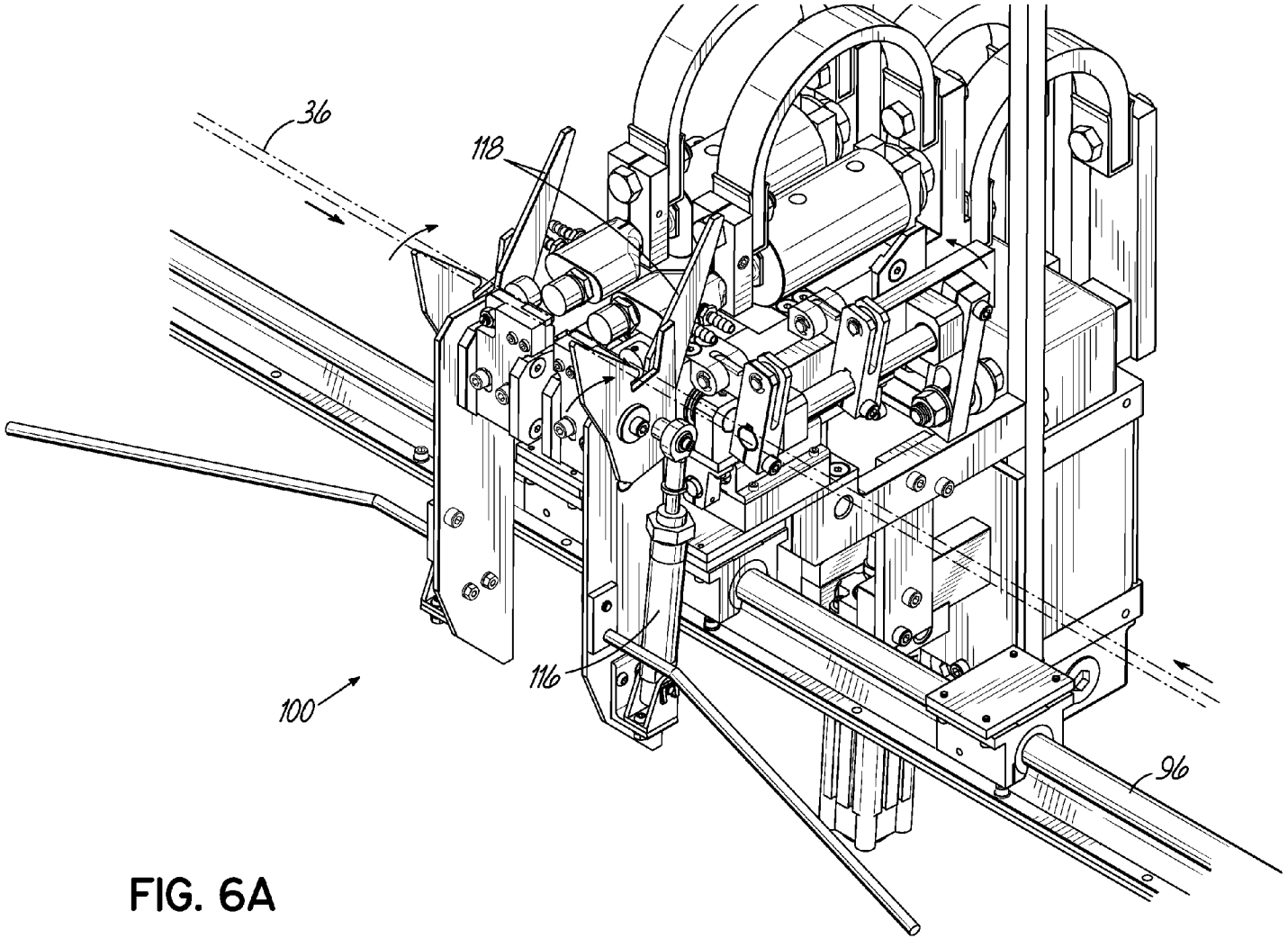
FIG. 6A is an enlarged perspective view of a portion of the apparatus shown in FIG. 6.
Figure 6B:
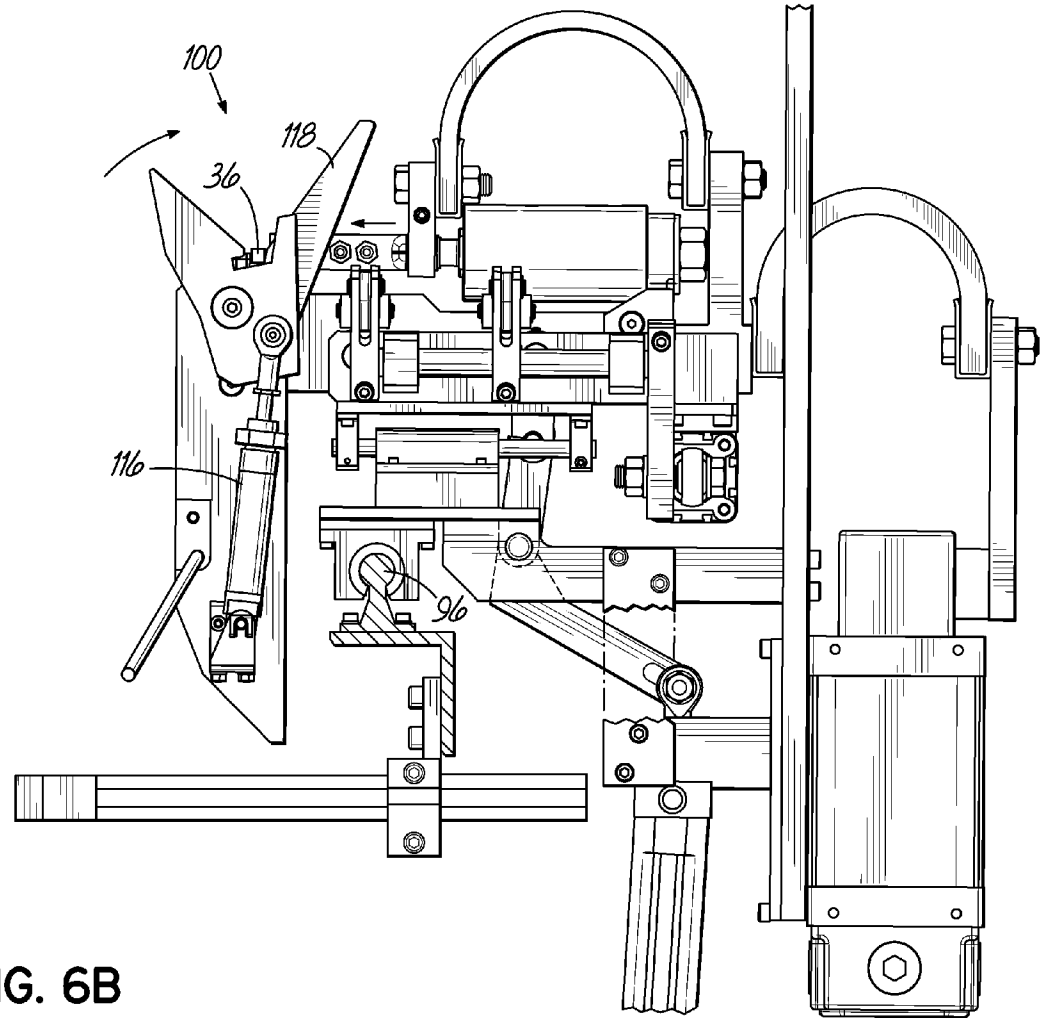
FIG. 6B is an enlarged perspective view of a portion of the apparatus shown in FIG. 6.
Figure 6C:
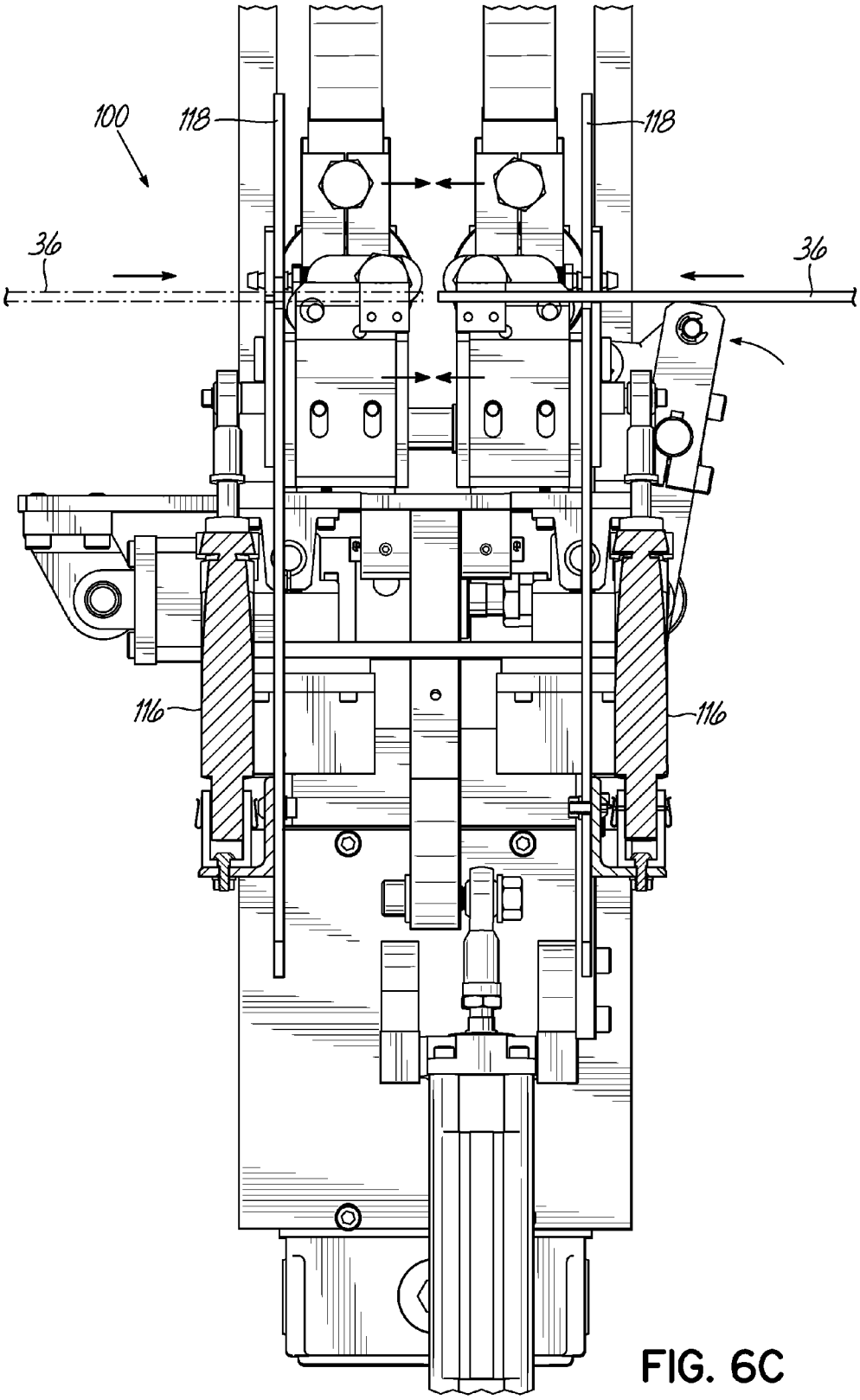
FIG. 6C is an enlarged perspective view of a portion of the apparatus shown in FIG. 6.

FIGS. 6, 6A, 6B and 6C illustrate enlarged views of the welding unit 100. FIG. 6A illustrates one of two weld eject cylinders 116 referenced in the flow chart of FIG. 8. The weld eject cylinders 116 pivot V-shaped members 118 to move the completed border wire 30 forwardly to cool before being passed along wire guide 40.

FIG. 7 illustrates a servo motor 106 which, when activated, may raise or lower the lower bending assemblies 28*c*, 28*d* and the welding unit 100. The servo motor 106 drives a drive train, which causes rotation of two vertical drive rods 108 (only one being shown in FIG. 7). Rotation of vertical drive rods 108 moves the lower drive assembly 110 up or down depending upon the direction of rotation.

While the invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. Therefore, the invention in its broadest aspects is not limited to the specific details shown and described. The various features disclosed herein may be used in any combination necessary or desired for a particular application. Consequently, departures may be made from the details described herein without departing from the spirit and scope of the claims which follow.

What is claimed is:

1. A method of making a border wire for a bedding product, the method comprising:

providing a source of wire having a circular cross-section;

passing the wire having a circular cross-section through a metal forming machine to create a wire having a rectangular cross-section;

accumulating the wire having a rectangular cross-section in an accumulator;

passing the wire having a rectangular cross-section through a three-axis straightener;

measuring a predetermined length of wire having a rectangular cross-section;

cutting the wire having a rectangular cross-section to a predetermined length to obtain a piece of wire having a rectangular cross-section;

bending the piece of wire having a rectangular cross-section using four bending assemblies into a rectangular configuration;

butt welding opposed ends of the piece of wire having a rectangular cross-section to create a rectangular border wire.

2. The method of claim 1, further comprising ejecting the rectangular border wire from an apparatus used to practice the method.

3. The method of claim 1, wherein the metal forming machine is a Turks Head.

4. The method of claim 1, wherein the position of the bending assemblies may be changed.

5. The method of claim 1, further comprising straightening the wire having a circular cross-section before it is passed through the metal forming machine.

6. The method of claim 1, further comprising servo driven feed rolls.

7. The method of claim 6, wherein the feed rolls pull the wire having a rectangular cross-section through the three-axis straightener.

8. The method of claim 1, wherein the wire having a rectangular cross-section passes through guides before being cut.

9. The method of claim 8, wherein the guides open upon activation.

10. A method of making a border wire for a bedding product, the method comprising:

passing a wire having a circular cross-section through a metal forming machine to create a wire having a rectangular cross-section;

accumulating the wire having a rectangular cross-section in an accumulator;

passing the wire having a rectangular cross-section through a three-axis straightener;

measuring a predetermined length of wire having a rectangular cross-section;

cutting the wire having a rectangular cross-section to a predetermined length to obtain a piece of wire having a rectangular cross-section;

bending the piece of wire having a rectangular cross-section into a rectangular configuration using four bending assemblies;

welding opposed ends of the piece of wire having a rectangular cross-section to create a rectangular border wire.

11. The method of claim 10 wherein each bending assembly is driven by a servo motor.

12. The method of claim 10 wherein the step of accumulating the wire having a rectangular cross-section in an accumulator includes adjusting the accumulator.

13. The method of claim 10 wherein the step of welding opposed ends of the piece of wire having a rectangular cross-section to create a rectangular border wire comprises butt welding.

14. The method of claim 10, further comprising ejecting the rectangular border wire from an apparatus used to practice the method.

15. A method of making a border wire for a bedding product, the method comprising:

unwinding wire having a circular cross-section from a spool of wire;

passing the wire having a circular cross-section through a metal forming machine to create a wire having a rectangular cross-section;

accumulating the wire having a rectangular cross-section in an accumulator;

passing the wire having a rectangular cross-section through a three-axis straightener;

measuring a predetermined length of wire having a rectangular cross-section;

cutting the wire having a rectangular cross-section to obtain a piece of wire having a rectangular cross-section;

bending the piece of wire having a rectangular cross-section using four bending assemblies into a rectangular configuration;

welding opposed ends of the piece of wire having a rectangular cross-section to create a border wire.

16. The method of claim 15 wherein each bending assembly is driven by a servo motor.

17. The method of claim 15 wherein the step of accumulating the wire having a rectangular cross-section in an accumulator includes adjusting the accumulator.

18. The method of claim 15 wherein the step of welding opposed ends of the piece of wire having a rectangular cross-section to create a rectangular border wire comprises butt welding.

19. The method of claim 15, further comprising ejecting the rectangular border wire.

* * * * *